US008656747B2

(12) United States Patent
Armstrong et al.

(10) Patent No.: US 8,656,747 B2
(45) **Date of Patent: *Feb. 25, 2014**

(54) KEYING SYSTEM AND METHOD

(75) Inventors: Steven Armstrong, San Juan Capistrano, CA (US); Gerald B. Chong, Rowland Heights, CA (US)

(73) Assignee: Kwikset Corporation, Foothill Ranch, CA (US)

( * ) Notice: Subject to any disclaimer, the term of this patent is extended or adjusted under 35 U.S.C. 154(b) by 1131 days.

This patent is subject to a terminal disclaimer.

(21) Appl. No.: 12/174,025

(22) Filed: Jul. 16, 2008

(65) Prior Publication Data

US 2008/0271505 A1 Nov. 6, 2008

Related U.S. Application Data

(60) Continuation of application No. 11/923,058, filed on Oct. 24, 2007, now Pat. No. 7,434,431, which is a continuation of application No. 11/465,921, filed on Aug. 21, 2006, now Pat. No. 7,322,219, which is a division of application No. 11/011,530, filed on Dec. 13, 2004, now Pat. No. 7,114,357, which is a continuation-in-part of application No. 10/256,066, filed on Sep. 26, 2002, now Pat. No. 6,860,131.

(51) Int. Cl.

| | |
|---|---|
| ***E05B 27/04*** | (2006.01) |
| ***E05B 29/04*** | (2006.01) |
| ***E05B 35/10*** | (2006.01) |

(52) U.S. Cl.

USPC ..... 70/492; 70/340; 70/341; 70/383; 70/384; 70/493; 70/495

(58) Field of Classification Search

USPC ..... 70/337–343, 382–385, 368, 492, 493, 70/495, 496

See application file for complete search history.

(56) References Cited

U.S. PATENT DOCUMENTS

| | | | |
|---|---|---|---|
| 1,565,556 | A | 12/1925 | Fremon |
| 1,610,224 | A | 12/1926 | Dalboni et al. |
| 1,845,867 | A | 2/1932 | Ellingson |
| 1,965,889 | A | 7/1934 | Gerald |
| 2,139,842 | A | 12/1938 | Miller |
| 2,194,469 | A | 3/1940 | Fremon |
| 2,232,017 | A | 2/1941 | Wilder |
| 2,370,862 | A | 3/1945 | Johnstone |
| 2,391,832 | A | 12/1945 | Johnstone |
| 2,895,323 | A | 7/1959 | Ernest |
| 2,977,786 | A | 4/1961 | Marron |
| 3,149,486 | A | 9/1964 | Russell |
| 3,183,692 | A | 5/1965 | Check |

(Continued)

FOREIGN PATENT DOCUMENTS

| | | |
|---|---|---|
| DE | 19544840 A1 | 6/1997 |
| EP | 0157967 | 10/1985 |

(Continued)

*Primary Examiner* — Lloyd Gall
(74) *Attorney, Agent, or Firm* — Barnes & Thornburg LLP

(57) ABSTRACT

A kit for a master keying system includes a plurality of replacement master racks. A rack removal key is provided for insertion into a keyway. The rack removal key has a first cut defining a first lift amount. A rack removal tool is provided for insertion into the keyway. The rack removal tool has a second cut defining a second lift amount, wherein the second lift amount is greater than the first lift amount.

6 Claims, 47 Drawing Sheets

(56) References Cited

U.S. PATENT DOCUMENTS

| | | | | |
|---|---|---|---|---|
| 3,190,093 | A | 6/1965 | Schlage | |
| 3,261,189 | A | 7/1966 | Best | |
| 3,320,781 | A | 5/1967 | Hill | |
| 3,431,757 | A | 3/1969 | Hori | |
| 3,589,153 | A | 6/1971 | Hill | |
| 3,667,262 | A | 6/1972 | Hill | |
| 3,693,384 | A | 9/1972 | Genakis | |
| 3,726,116 | A | 4/1973 | Dimotta | |
| 3,728,880 | A | 4/1973 | Falk | |
| 3,735,612 | A | 5/1973 | Popovici | |
| 3,754,422 | A | 8/1973 | Stackhouse | |
| 3,910,083 | A | 10/1975 | Burlingame | |
| 3,974,671 | A | 8/1976 | Rossetti | |
| 3,990,282 | A | 11/1976 | Sorum | |
| 3,999,413 | A | 12/1976 | Raymond et al. | |
| 4,015,458 | A | 4/1977 | Mercurio | |
| 4,069,694 | A | 1/1978 | Raymond et al. | |
| 4,094,175 | A | 6/1978 | Pechner | |
| 4,142,391 | A | 3/1979 | Paig | |
| 4,320,639 | A | 3/1982 | Kleefeldt et al. | |
| 4,372,139 | A | 2/1983 | Laake | |
| 4,376,382 | A | 3/1983 | Raymond et al. | |
| 4,377,940 | A | 3/1983 | Hucknall | |
| 4,393,673 | A * | 7/1983 | Widen | 70/358 |
| 4,404,824 | A | 9/1983 | Hennessy | |
| 4,412,437 | A | 11/1983 | Smith | |
| 4,440,009 | A | 4/1984 | Smith | |
| 4,689,978 | A | 9/1987 | Drummond | |
| 4,712,399 | A | 12/1987 | Mattossovich | |
| 4,712,401 | A | 12/1987 | Monahan | |
| 4,712,402 | A | 12/1987 | Monahan | |
| 4,723,427 | A | 2/1988 | Oliver | |
| 4,729,231 | A | 3/1988 | Wu | |
| 4,732,023 | A | 3/1988 | Shen | |
| 4,741,188 | A | 5/1988 | Smith | |
| 4,747,281 | A | 5/1988 | Monahan | |
| 4,765,163 | A | 8/1988 | Trull et al. | |
| 4,794,772 | A | 1/1989 | Falk et al. | |
| 4,836,002 | A | 6/1989 | Monahan | |
| 4,850,210 | A | 7/1989 | Adler et al. | |
| 4,899,563 | A | 2/1990 | Martin | |
| 4,909,053 | A | 3/1990 | Zipf, III et al. | |
| 4,912,953 | A | 4/1990 | Wobig | |
| 4,920,774 | A | 5/1990 | Martin | |
| 4,942,749 | A | 7/1990 | Rabinow | |
| 4,966,021 | A | 10/1990 | Boag | |
| 4,996,856 | A | 3/1991 | Lin et al. | |
| 5,000,019 | A | 3/1991 | Foster | |
| 5,010,753 | A | 4/1991 | Boris, Jr. | |
| 5,024,071 | A | 6/1991 | Shafirkin | |
| 5,038,589 | A | 8/1991 | Martin | |
| 5,044,180 | A | 9/1991 | Lebrecht | |
| 5,044,185 | A | 9/1991 | Green | |
| 5,076,081 | A | 12/1991 | Boris, Jr. | |
| 5,088,305 | A | 2/1992 | Myers | |
| 5,121,619 | A | 6/1992 | Martin | |
| 5,174,136 | A | 12/1992 | Thwing | |
| 5,209,088 | A | 5/1993 | Vaks | |
| 5,211,044 | A | 5/1993 | Kim | |
| 5,233,850 | A | 8/1993 | Schroeder | |
| 5,325,690 | A | 7/1994 | Adler et al. | |
| 5,428,978 | A | 7/1995 | Tsukano | |
| 5,431,034 | A | 7/1995 | Fann et al. | |
| 5,540,071 | A | 7/1996 | Reikher | |
| 5,640,865 | A | 6/1997 | Widen | |
| 5,704,234 | A | 1/1998 | Resch | |
| 5,718,136 | A | 2/1998 | Aldieri et al. | |
| 5,752,400 | A | 5/1998 | Kim | |
| 5,765,417 | A | 6/1998 | Bolton | |
| 5,791,181 | A | 8/1998 | Sperber et al. | |
| 5,884,512 | A | 3/1999 | Wayne | |
| 5,921,122 | A | 7/1999 | Lin | |
| 5,921,123 | A | 7/1999 | Schwarzkopf et al. | |
| 5,970,760 | A | 10/1999 | Shen | |
| 5,979,200 | A | 11/1999 | Cliff | |
| 6,029,484 | A | 2/2000 | Jetton | |
| 6,047,577 | A | 4/2000 | Klimas | |
| 6,076,386 | A | 6/2000 | Etchells et al. | |
| 6,079,240 | A | 6/2000 | Shvarts | |
| 6,119,495 | A | 9/2000 | Loreti | |
| 6,134,928 | A | 10/2000 | Kang | |
| 6,142,717 | A | 11/2000 | Staiger | |
| 6,295,850 | B1 | 10/2001 | Anderson | |
| 6,425,274 | B1 | 7/2002 | Laitala et al. | |
| 6,516,643 | B1 | 2/2003 | Olshausen | |
| 6,523,378 | B2 | 2/2003 | Kuo | |
| 6,532,782 | B2 | 3/2003 | Chiu | |
| 6,564,601 | B2 | 5/2003 | Hyatt Jr. | |
| 6,776,017 | B2 | 8/2004 | Herdman | |
| 6,860,131 | B2 | 3/2005 | Armstrong et al. | |
| 6,862,909 | B2 | 3/2005 | Armstrong et al. | |
| 6,871,520 | B2 | 3/2005 | Armstrong et al. | |
| 6,959,569 | B2 | 11/2005 | Strader et al. | |
| 7,007,528 | B2 | 3/2006 | Chong et al. | |
| 7,114,357 | B2 | 10/2006 | Armstrong et al. | |
| 7,117,701 | B2 | 10/2006 | Armstrong et al. | |
| 7,213,429 | B2 | 5/2007 | Armstrong et al. | |
| 7,234,331 | B2 | 6/2007 | Armstrong et al. | |
| 7,308,811 | B2 | 12/2007 | Armstrong et al. | |
| 7,322,219 | B2 * | 1/2008 | Armstrong et al. | 70/492 |
| 7,434,431 | B2 * | 10/2008 | Armstrong et al. | 70/492 |
| 2003/0037582 | A1 | 2/2003 | Edwards, Jr. et al. | |
| 2003/0084692 | A1 | 5/2003 | Herdman | |
| 2003/0089149 | A1 | 5/2003 | Suzuki et al. | |
| 2003/0154753 | A1 | 8/2003 | Dimig et al. | |
| 2004/0069030 | A1 | 4/2004 | Takadama | |
| 2006/0117822 | A1 | 6/2006 | Boesel et al. | |

FOREIGN PATENT DOCUMENTS

| | | |
|---|---|---|
| EP | 0210037 | 1/1987 |
| EP | 0872615 | 10/1998 |
| GB | 990987 | 5/1965 |
| GB | 1554877 | 10/1979 |
| JP | 7197705 A | 8/1995 |
| JP | 2001234648 A | 8/2001 |
| WO | 9314290 | 7/1993 |
| WO | 9736072 | 10/1997 |

* cited by examiner

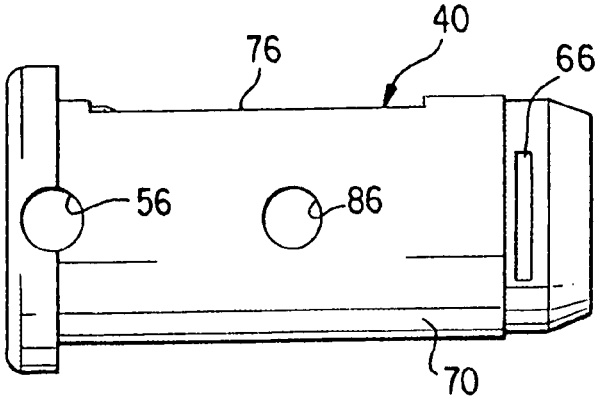
FIG. 16D
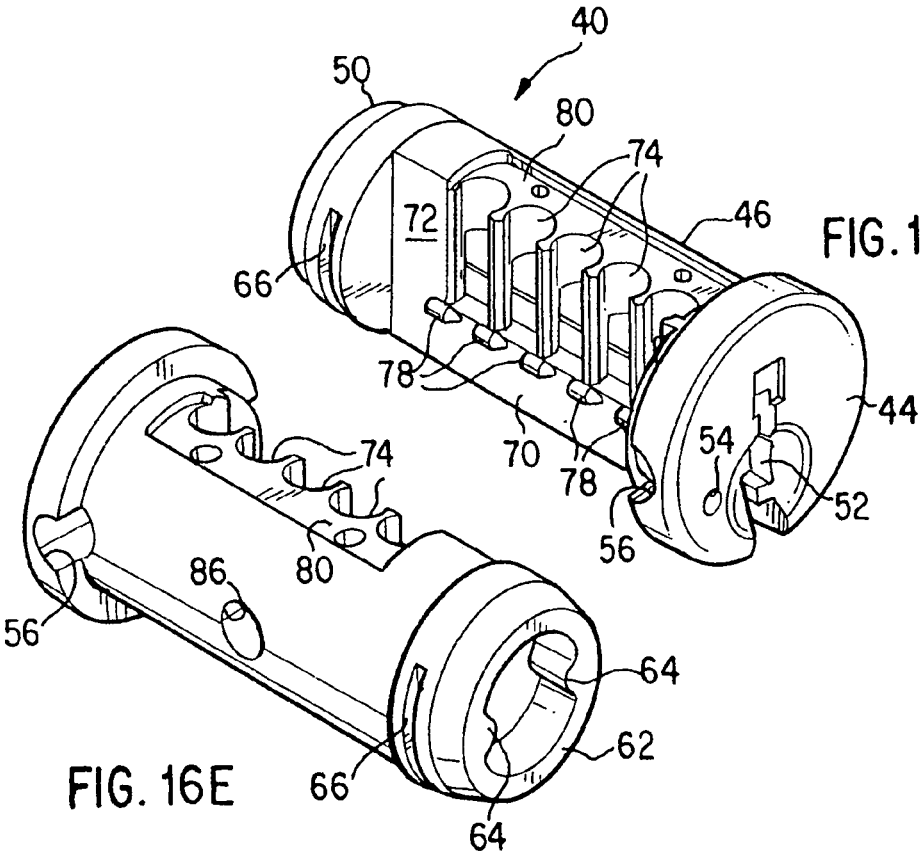
FIG. 16F
FIG. 16E

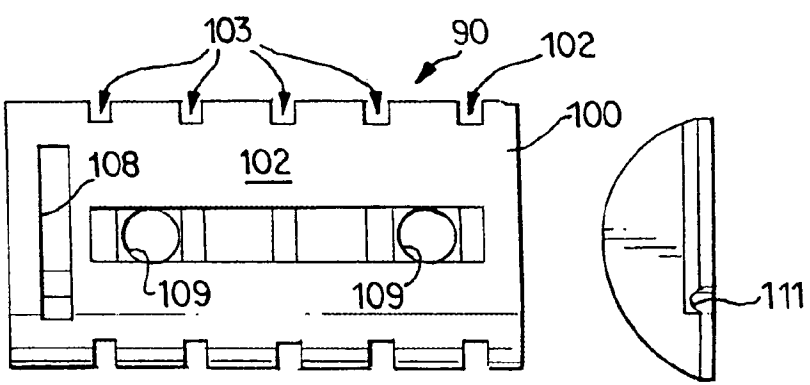
FIG.17D
FIG.17C
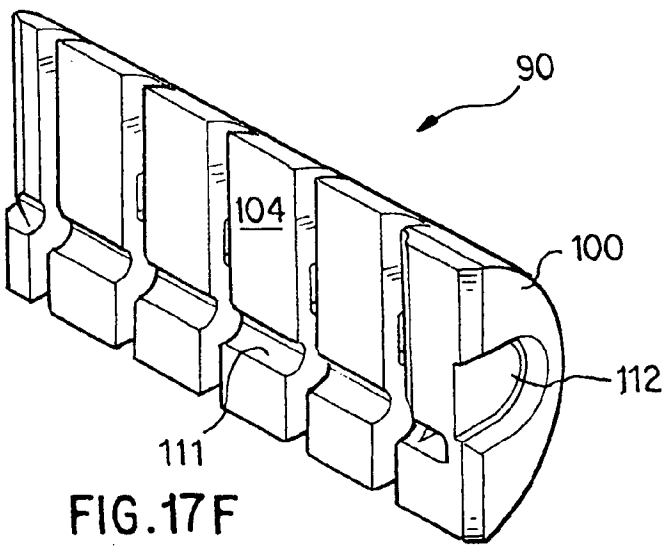
FIG.17F
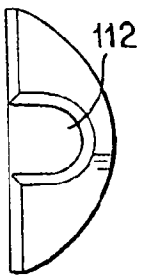
FIG.17B
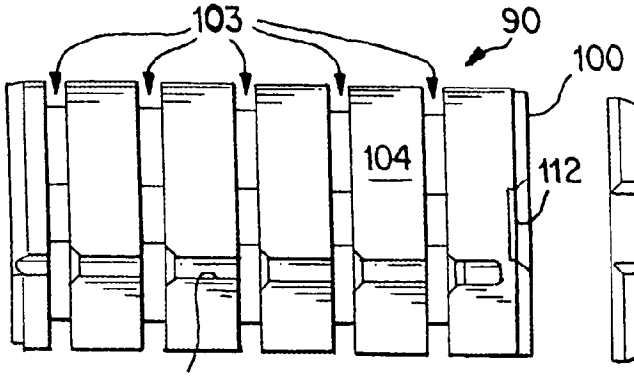
FIG.17A
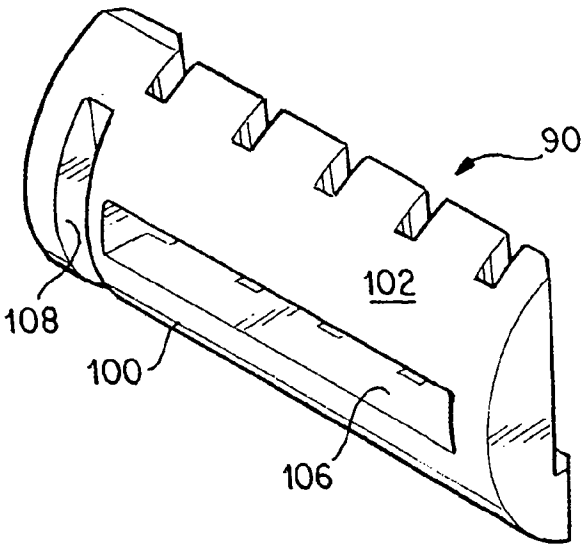
FIG.17E

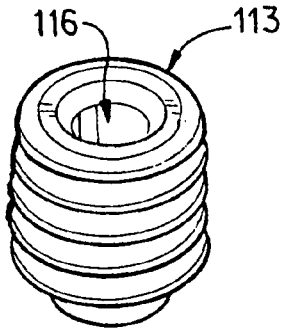
FIG. 20A
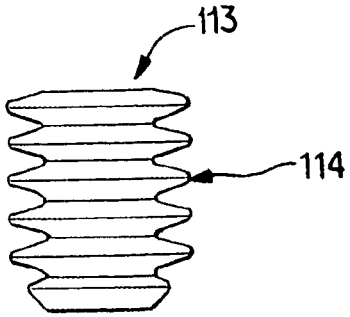
FIG. 20B
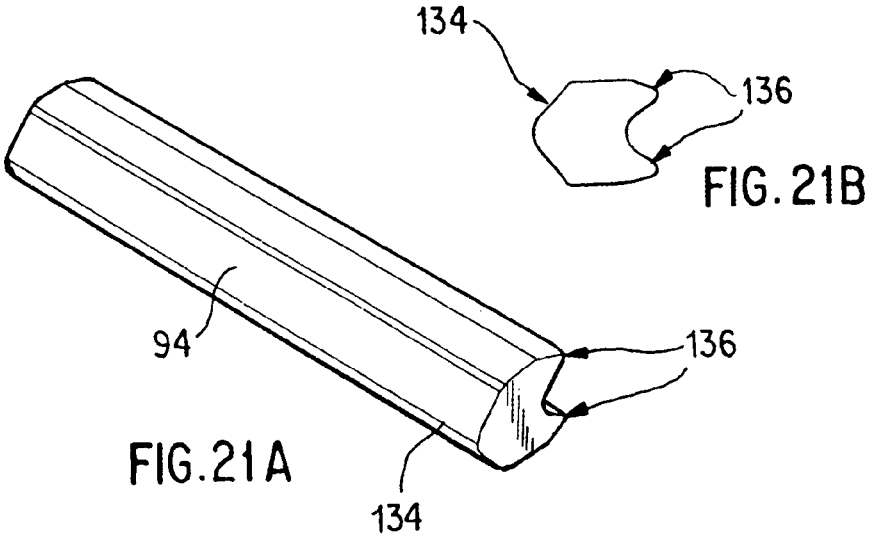
FIG. 21B
FIG. 21A

KEYING SYSTEM AND METHOD

This is a continuation of U.S. patent application Ser. No. 11/923,058, filed Oct. 24, 2007, now U.S. Pat. No. 7,434,431, which is a continuation of U.S. patent application Ser. No. 11/465,921, filed Aug. 21, 2006, now U.S. Pat. No. 7,322,219, which is a division of U.S. patent application Ser. No. 11/011,530 filed Dec. 13, 2004, now U.S. Pat. No. 7,114,357, which is a continuation-in-part of U.S. patent application Ser. No. 10/256,066 filed Sep. 26, 2002, now U.S. Pat. No. 6,860,131.

The present invention relates generally to lock cylinders and particularly to lock cylinders that can be rekeyed. More particularly, the invention relates to a keying system and method.

BACKGROUND OF THE INVENTION

When rekeying a cylinder using a traditional cylinder design, the user is required to remove the cylinder plug from the cylinder body and replace the appropriate pins so that a new key can be used to unlock the cylinder. This typically requires the user to remove the cylinder mechanism from the lockset and then disassemble the cylinder to some degree to remove the plug and replace the pins. This requires a working knowledge of the lockset and cylinder mechanism and is usually only performed by locksmiths or trained professionals. Additionally, the process usually employs special tools and requires the user to have access to pinning kits to interchange pins and replace components that can get lost or damaged in the rekeying process. Finally, professionals using appropriate tools can easily pick traditional cylinders.

In addition, in one form of a master keying system, such as a pin and tumbler design, master shims are positioned in between the pins of the lock cylinder to establish a shear line for the master key and user keys. In such a previous design, for example, the consumer replaces the pins and adds shims to convert the lock cylinder to a master keyed cylinder. This may be a complicated process for some consumers.

The present invention overcomes these and other disadvantages of conventional lock cylinders and master keying systems.

SUMMARY OF THE INVENTION

The present invention, in one form thereof, is directed to a keying method. The method includes providing a cylinder body and a plug assembly disposed in the cylinder body, the plug assembly having a keyway, a plug body and a carrier sub-assembly disposed adjacent the plug body, the carrier sub-assembly being moveable parallel to the longitudinal axis of the cylinder body between a first position and a retracted position, the plug assembly including a plurality of pins and a plurality of racks for respectively engaging the plurality of pins, each rack of the plurality of racks having a locking bar-receiving groove.

The method further includes moving the carrier sub-assembly that carries the plurality of racks to the retracted position to decouple the plurality of racks from the plurality of pins; inserting a rack removal key in the keyway, the rack removal key having a cut that lifts the plurality of pins by a first amount; releasing the carrier sub-assembly from the retracted position to reengage the plurality of racks with the plurality of pins; disengaging a locking bar from the locking bar-receiving groove of each rack of the plurality of racks to decouple the racks; removing the rack removal key from the keyway; inserting a rack removal tool into the keyway, the rack removal tool having a cut that lifts the plurality of pins by a second amount greater than the first amount; moving the carrier sub-assembly to the retracted position to decouple the plurality of racks from the plurality of pins; removing each rack to be replaced from a corresponding access hole on the cylinder body; inserting a corresponding replacement rack through a respective access hole for each of the racks to be replaced, each replacement rack having the locking bar-receiving groove; releasing the carrier sub-assembly from the retracted position to engage each of the racks installed in the carrier sub-assembly with a corresponding pin of the plurality of pins; removing the rack removal tool from the keyway; reinserting the rack removal key in the keyway; without removing the rack removal key, engaging the locking bar with the locking bar-receiving groove of each rack to couple together the racks installed in the carrier sub-assembly; moving the carrier sub-assembly to the retracted position to decouple each of the racks installed in the carrier sub-assembly from the corresponding pin of the plurality of pins; and removing the rack removal key from the keyway.

The present invention, in another form thereof, is directed to a master keying method. The method includes providing a lock cylinder having a cylinder body with a longitudinal axis, and a plug assembly disposed in the cylinder body, the plug assembly having a keyway, a plug body having a plurality of protrusion features, and a carrier sub-assembly disposed adjacent the plug body, the carrier sub-assembly being moveable parallel to the longitudinal axis of the cylinder body between a first position and a retracted position, the plug assembly including a plurality of pins and a plurality of racks for engaging the pins, each rack of the plurality of racks having a locking bar-receiving groove and a protrusion receiving groove.

The method further includes inserting a valid master key into the keyway; rotating the valid master key to rotate the plug assembly from an original position to a first position in a first rotational direction; moving the carrier sub-assembly to a retracted position to decouple the plurality of racks from the plurality of pins and position the protrusion receiving groove of each rack over a corresponding protrusion feature on the plug body; removing the valid master key from the keyway; inserting a rack removal key in the keyway, the rack removal key having a cut that lifts the plurality of pins by a first amount; rotating the plug assembly to a second position in the first rotational direction to release the carrier sub-assembly from the retracted position to reengage the plurality of racks with the plurality of pins; removing a side plug from the cylinder body to disengage a locking bar from the locking bar-receiving groove of each rack, thereby decoupling all of the plurality of racks from each other rack; removing the rack removal key from the keyway; inserting a rack removal tool into the keyway, the rack removal tool having a cut that lifts the plurality of pins by a second amount greater than the first amount; moving the carrier sub-assembly to the retracted position to decouple the plurality of racks from the plurality of pins and position each rack above the corresponding protrusion feature on the plug body; removing the racks from access holes in the cylinder body; inserting each of a plurality of master racks through a respective access hole, each master rack of the plurality of master racks having a master locking bar-receiving groove and a master protrusion receiving groove; releasing the carrier sub-assembly from the retracted position to engage the plurality of master racks with the plurality of pins; remove the rack removal tool from the keyway; reinsert the rack removal key in the keyway; without removing the rack removal key, reinstalling the side plug back on to the cylinder body so that the locking bar engages with the master locking bar-receiving groove of each master rack of the plurality of master racks, thereby coupling all of the plurality of master racks together; rotating the plug assembly to the first position in a second rotational direction opposite to the first rotational direction; moving the carrier sub-assembly to a retracted position to decouple the plurality of master racks from the plurality of pins and position the master protrusion receiving groove of each master rack over a corresponding protrusion feature on the plug body; removing the rack removal key from the keyway; inserting a new master key in the keyway; and rotating the plug body back in the second rotational direction back to the original position to release the carrier sub-assembly from the retracted position to reengage the plurality of master racks with the plurality of pins.

The present invention, in another form thereof, is directed to a keying system. The system includes a cylinder body having a longitudinal axis. A plug assembly is disposed in the cylinder body. The plug assembly has a keyway. The plug assembly includes a plug body and a carrier sub-assembly disposed adjacent the plug body. The carrier sub-assembly is moveable parallel to the longitudinal axis of the cylinder body between a first position and a second position. The plug assembly includes a plurality of pins and a plurality of racks for selectively engaging the plurality of pins. Each rack of the plurality of racks has a first locking bar-receiving groove along a neutral axis and at least a second locking bar-receiving groove spaced from the neutral axis. A spacing of the second locking bar-receiving groove from the neutral axis of a first rack of the plurality of racks is different from a spacing of the second locking bar-receiving groove from the neutral axis of at least one other of the plurality of racks.

The present invention, in still another form thereof, is directed to a kit for a master keying system. The kit includes a plurality of replacement master racks, a rack removal key for insertion into a keyway, and a rack removal tool for insertion into the keyway. The rack removal key has a first cut defining a first lift amount. The rack removal tool has a second cut defining a second lift amount. The second lift amount is greater than the first lift amount.

The present invention, in still another form thereof, is directed to a keying method, including providing a plurality of replacement master racks to be installed in a movable carrier assembly of a lock cylinder; and manipulating the movable carrier assembly with a rack removal key and a rack removal tool, each of the rack removal key and the rack removal tool being configured for insertion into a keyway of the lock cylinder, the rack removal key having a first cut defining a first lift amount, and the rack removal tool having a second cut defining a second lift amount, the second lift amount being greater than the first lift amount.

Other features and advantages will become apparent from the following description when viewed in accordance with the accompanying drawings and appended claims.

BRIEF DESCRIPTION OF THE DRAWINGS

FIGS. 16*a*-16*f* are various views of the cylinder plug body for use in the present invention.

FIGS. 17*a*-17*f* are various view of the carrier for use in the present invention.

FIGS. 20*a*-20*b* are views of a pin for use in the present invention.

FIGS. 21*a*-21*b* are views of a locking bar for use in the present invention.

DETAILED DESCRIPTION OF THE DRAWINGS

Figure 1:
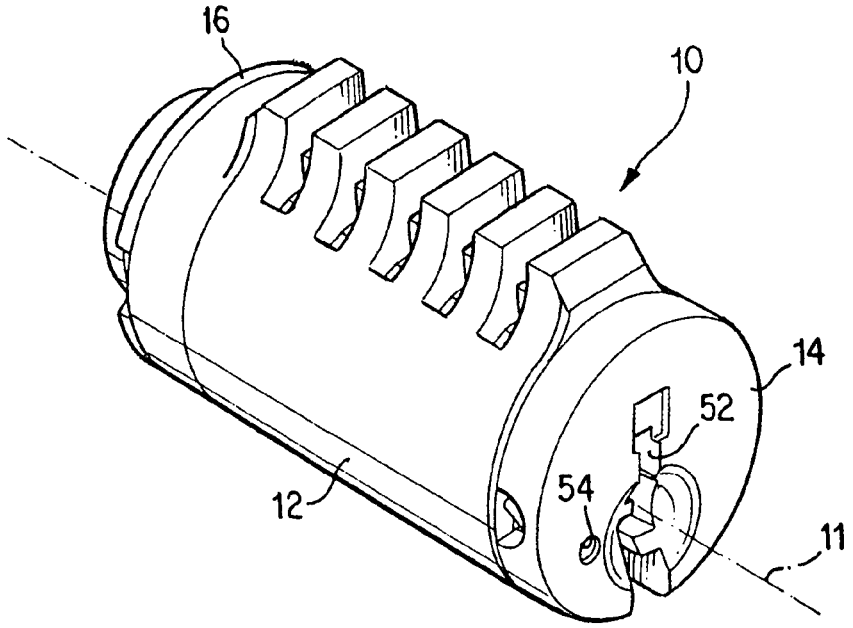
FIG. 1 illustrates a lock cylinder according to the present invention.
Figure 2:
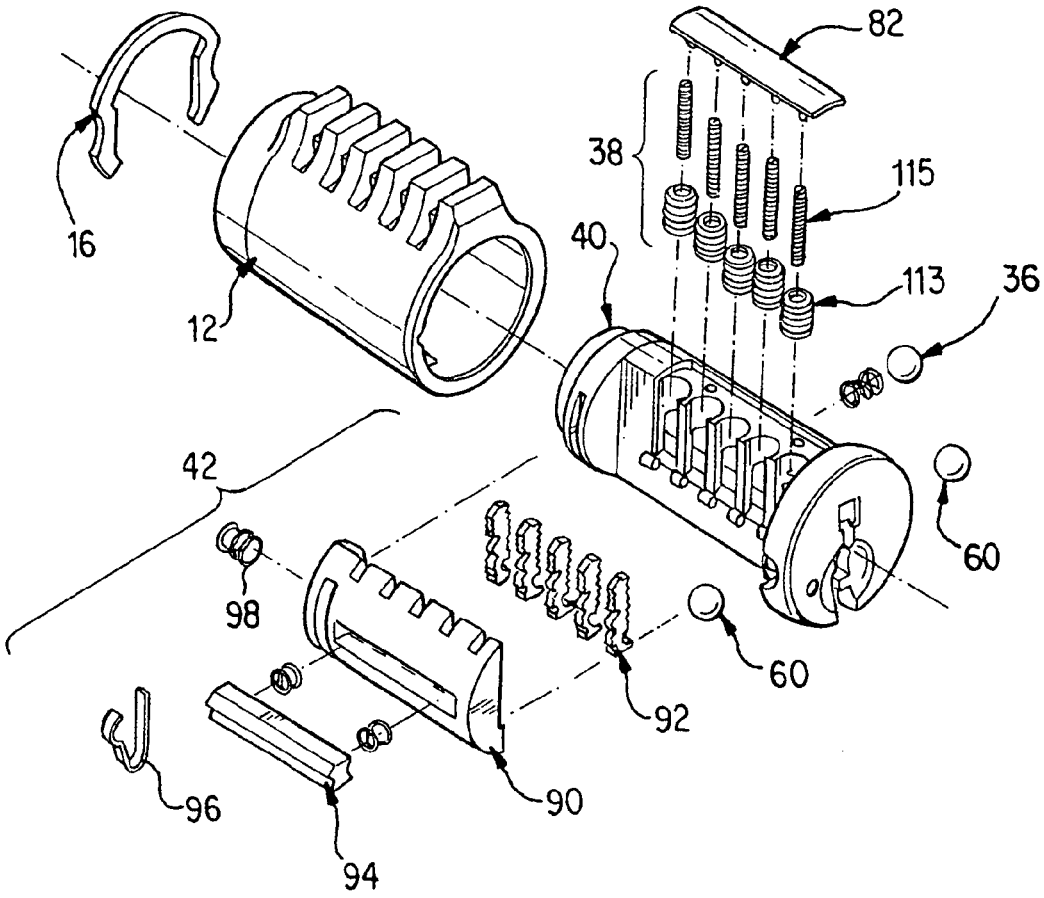
FIG. 2 is an exploded view of the lock cylinder of FIG. 1.

A lock cylinder 10 according to the present invention is illustrated in FIG. 1-2. The lock cylinder 10 includes a longitudinal axis 11, a lock cylinder body 12, a plug assembly 14 and a retainer 16. In FIG. 1, the plug assembly 14 is in the home position relative to the cylinder body 12.

The lock cylinder body 12, as seen in FIGS. 15*a*-15*e*, includes a generally cylindrical body 20 having a front end 22, a back end 24 and a cylinder wall 26 defining an interior surface 28. The cylinder wall 26 includes an interior, locking bar-engaging groove 29 and a pair of detent recesses 30, 32. The generally V-shaped locking bar-engaging groove 29 extends longitudinally along a portion of the cylinder body 12 from the front end 22. The first detent recess 30 is disposed at the back end 24 and extends to a first depth. The second detent recess 32 is disposed adjacent the first detent recess 30 and extends to a lesser depth. A detent bore 34 extends radially through the cylinder wall 26 for receiving a detent ball 36 (FIG. 2).

The plug assembly 14 includes a plug body 40, a carrier sub-assembly 42 and a plurality of spring-loaded pins 38 (FIGS. 2 and 20*a*-20*b*). The plug body 40, illustrated in FIGS. 16*a*-16*f*, includes a plug face 44, an intermediate portion 46 and a drive portion 50. The plug face 44 defines a keyway opening 52, a rekeying tool opening 54 and a pair of channels 56 extending radially outwardly for receiving anti-drilling ball bearings 60 (FIG. 2). The drive portion 50 includes an annular wall 62 with a pair of opposed projections 64 extending radially inwardly to drive a spindle or torque blade (neither shown). The drive portion 50 further includes a pair of slots 66 formed in its perimeter for receiving the retainer 16 to retain the plug body 40 in the cylinder body 12.

The intermediate portion 46 includes a main portion 70 formed as a cylinder section and having a first longitudinal planar surface 72 and a plurality of channels 74 for receiving the spring-loaded pins 38. The channels 74 extend transversely to the longitudinal axis of the plug body 40 and parallel to the planar surface 72. A second planar surface 76 extends perpendicular to the first planar surface 72 and defines a recess 80 for receiving a retaining cap 82 (FIGS. 2 and 22*a*-22*d*). The channels 74 extend from the second planar surface 76 partially through the plug body 40, with the sidewalls of the channels open to the first planar surface 72. The first planar surface 72 further includes a plurality of bullet-shaped, rack-engaging features 78. A bore 86 for receiving a spring-loaded detent ball 36 (FIG. 2) extends radially inwardly from opposite the first planar surface 72.

Figure 6:
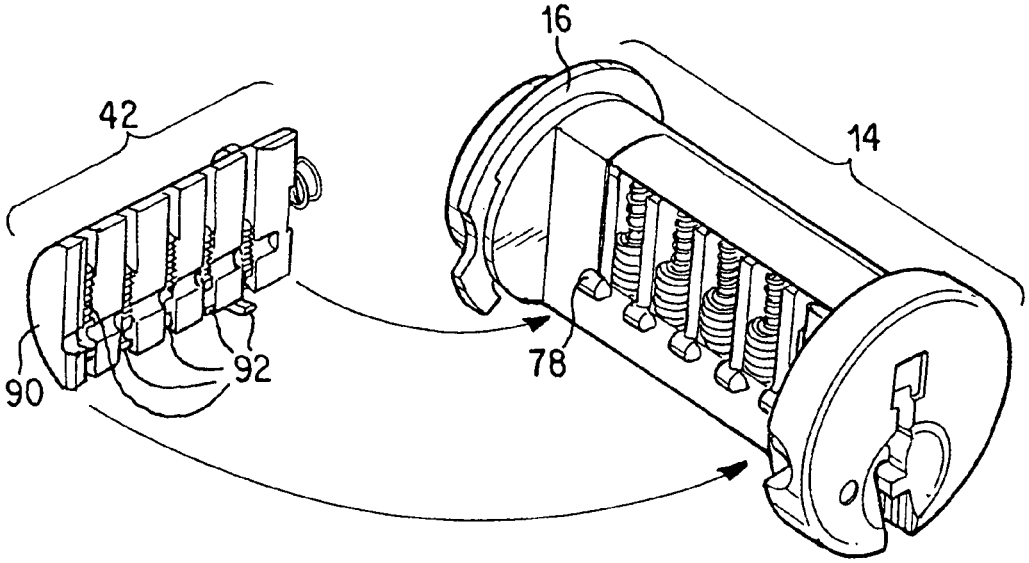
FIG. 6 is a partially exploded view of the plug assembly of FIG. 3.
Figure 10:
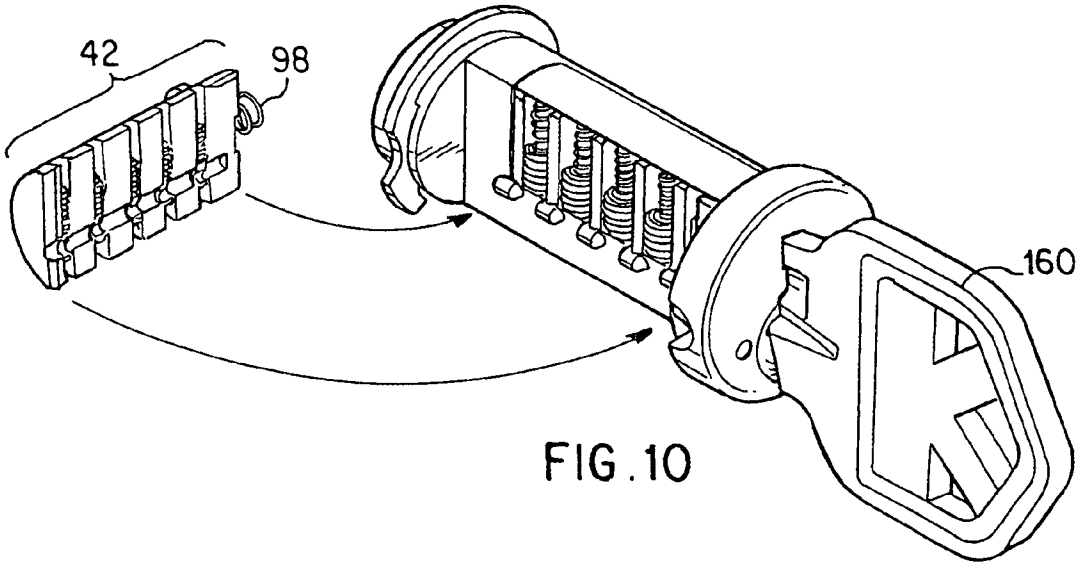
FIG. 10 is a partially broken away side view of the plug assembly of FIG. 8.
Figure 11:
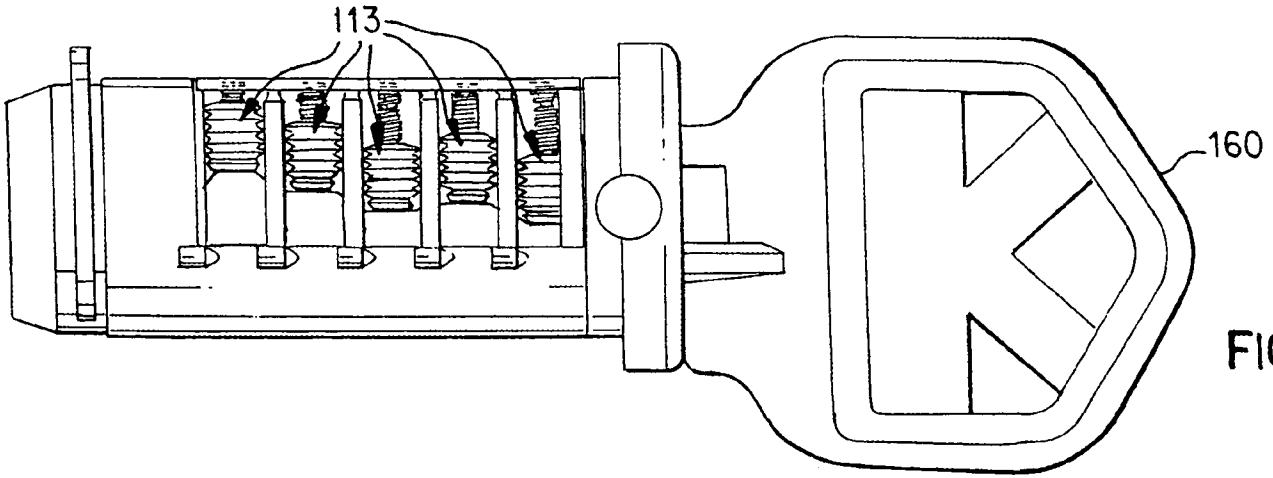
FIG. 11 is a partially exploded view of the plug assembly of FIG. 8.
Figure 18A:
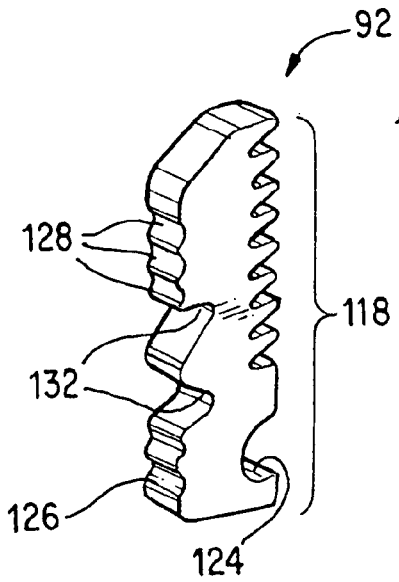
FIGS. 18*a*-18*b* are views of a rack for use in the present invention.
Figure 18B:
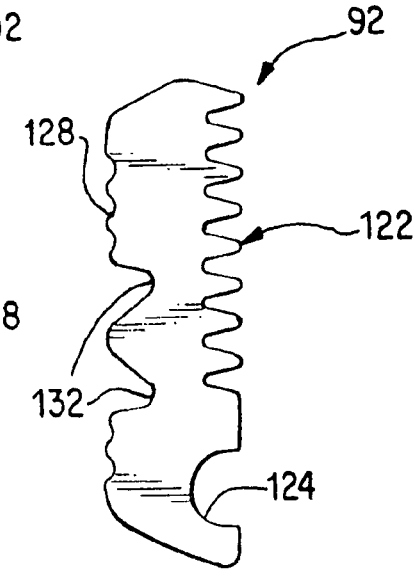
Figure 19A:
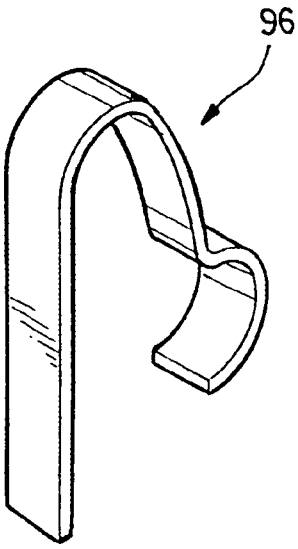
FIGS. 19*a*-19*b* are views of a spring catch for use in the present invention.
Figure 19B:
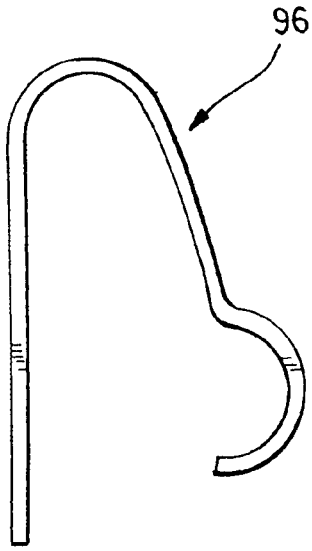
Figure 22A:
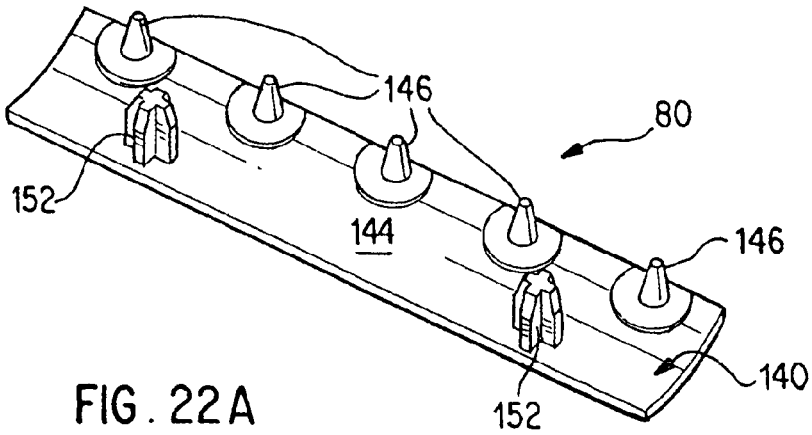
FIGS. 22*a*-22*d* are views of a spring retaining cap for use in the present invention.
Figure 22B:
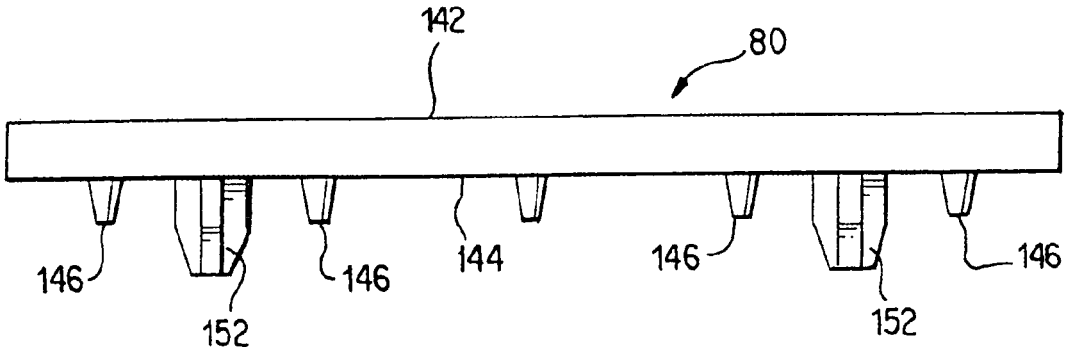
Figure 22C:
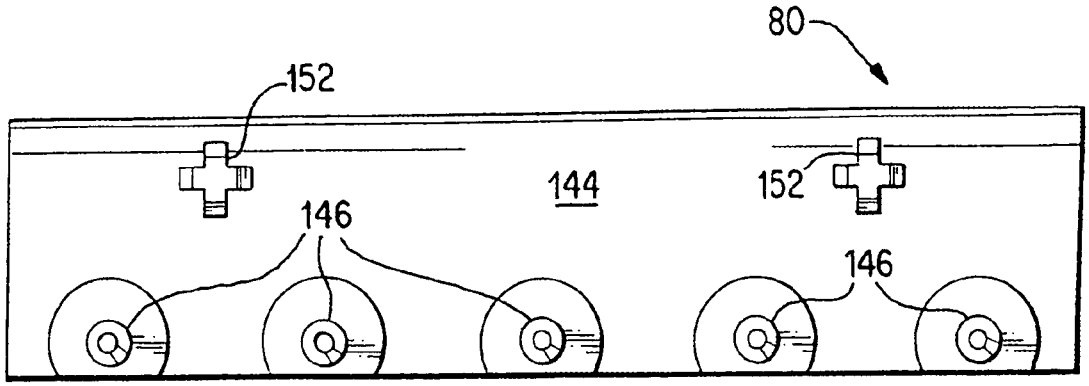
Figure 22D:
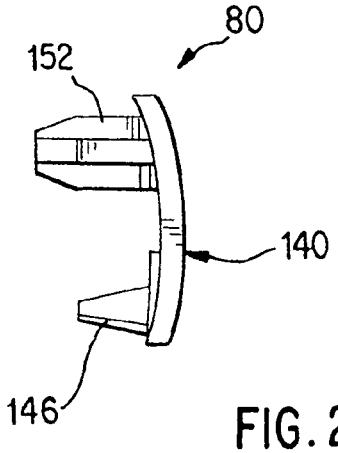

The carrier sub-assembly 42 (FIGS. 2, 6 and 10) includes a carrier 90 (FIGS. 17*a*-17*e*), a plurality of racks 92 (FIGS. 18*a*-18*b*), a spring catch 96 (FIGS. 19*a*-19*b*), a spring-loaded locking bar 94 (FIGS. 21*a*-21*b*), and a return spring 98 (FIG. 2). The carrier 90 includes a body 100 in the form of a cylinder section that is complementary to the main portion 70 of the plug body 40, such that the carrier 90 and the main portion 70 combine to form a cylinder that fits inside the lock cylinder body 12. The carrier 90 includes a curved surface 102 and a flat surface 104. The curved surface 102 includes a locking bar recess 106 and a spring catch recess 108. The locking bar recess 106 further includes a pair of return spring-receiving bores 109 (FIG. 17*c*) for receiving the locking bar return springs. The flat surface 104 includes a plurality of parallel rack-receiving slots 103 extending perpendicular to the longitudinal axis of the carrier. A semi-circular groove 111 extends along the flat surface 104 parallel to the longitudinal axis of the carrier 90. The back end of the carrier 90 includes a recess 112 for receiving the return spring 98.

Figure 7:
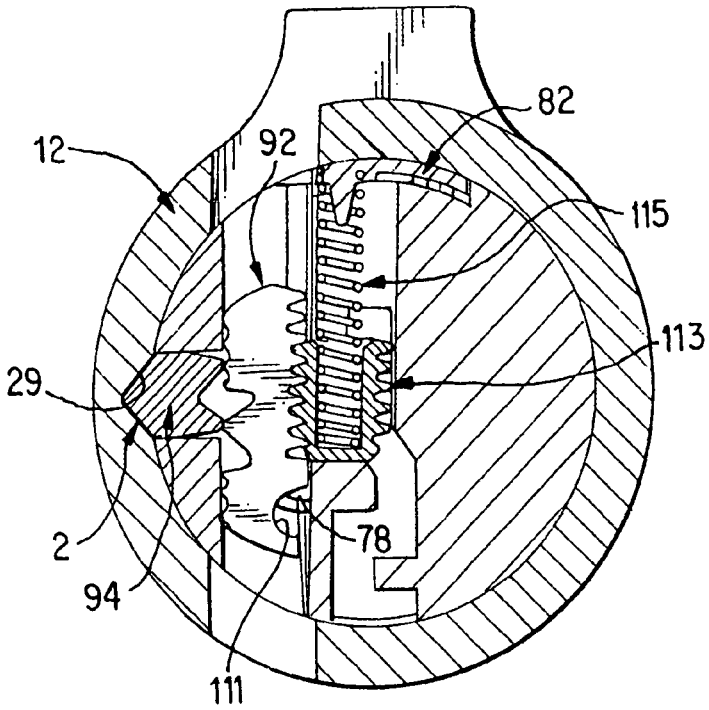
FIG. 7 is a section view through the plug assembly of FIG. 3 and a cylinder body, the section being taken transversely at one of the pins and illustrating the positioning of the pin, a rack, and the locking bar relative to each other and the cylinder body in a locked configuration.
Figure 12:
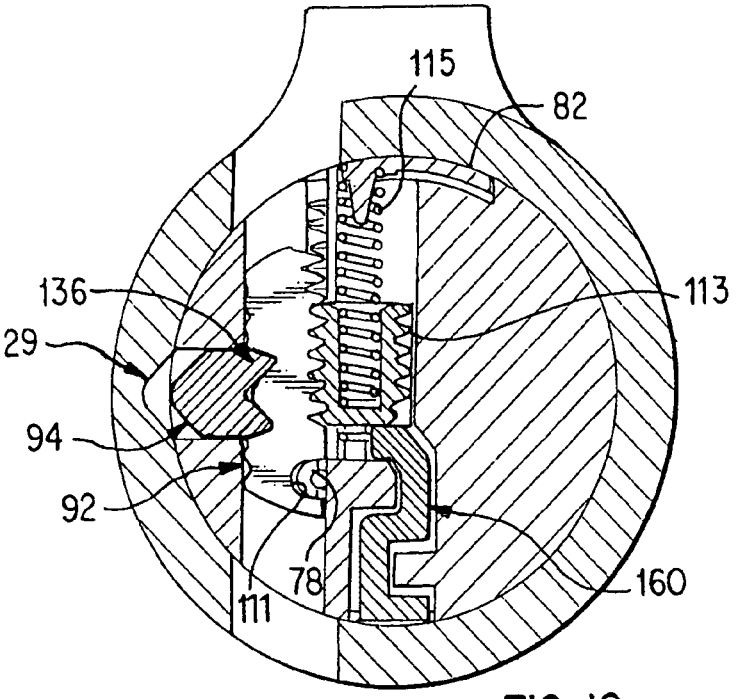
FIG. 12 is a section view through the plug assembly of FIG. 8 and a cylinder body, the section being taken transversely at one of the pins and illustrating the positioning of the pin, the rack, and the locking bar relative to each other and the cylinder body in an unlocked configuration.

Each spring-loaded pin 38 includes a pin 113 and a biasing spring 115. The pins 113, illustrated in FIGS. 20*a*-20*b*, are generally cylindrical with annular gear teeth 114 and a central longitudinal bore 116 for receiving biasing springs 115 (FIG. 2). The racks 92, illustrated in FIGS. 18*a*-18*b*, include a pin-engaging surface 118 having a plurality of gear teeth 122 configured to engage the annular gear teeth 114 on the pins 113, as illustrated in FIGS. 7 and 12, and a semi-circular recess 124 for engaging the bullet-shaped, rack-engaging features 78 on the planar surface 72, as illustrated in FIG. 12. The racks 92 further include a second surface 126 that includes a plurality of anti-pick grooves 128 and a pair of locking bar-engaging grooves 132.

The spring-loaded locking bar 94, illustrated in FIGS. 21*a*-22*b*, is sized and configured to fit in the locking bar recess 106 in the carrier 90 and includes a triangular edge 134 configured to fit in the V-shaped locking bar-engaging groove 29. Opposite the triangular edge 134, the locking bar 94 includes a pair of longitudinally extending gear teeth 136 configured to engage the locking bar-engaging grooves 132 formed in the racks 92, as illustrated in FIG. 12.

The spring-retaining cap 82, illustrated in FIGS. 22*a*-22*d*, includes a curvilinear portion 140 having an upper surface 142 and a lower surface 144. The thickness of the curvilinear portion 140 is set to allow the curvilinear portion 140 to fit in the recess 80 with the upper surface 142 flush with the intermediate portion 46 of the plug body 40, as illustrated in FIGS. 7 and 12. A plurality of spring alignment tips 146 extend from the lower surface 144 to engage the springs 115. In addition, a pair of cap retaining tips 152 extend from the lower surface 144 to engage alignment openings 154 formed in the plug body 40 (FIGS. 16*e*-16*f*).

Figure 3:
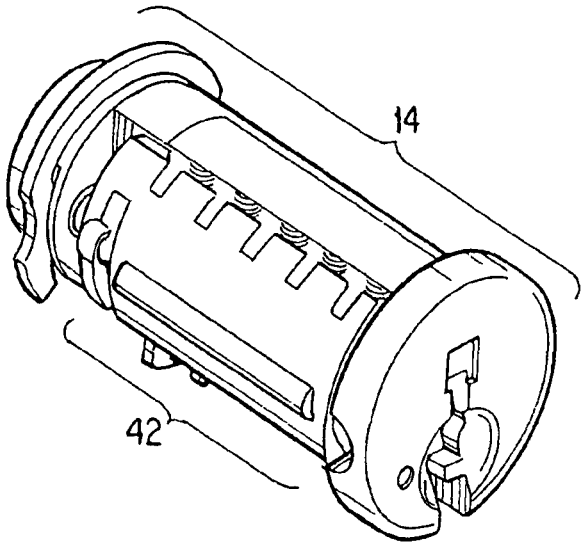
FIG. 3 is a perspective view of a plug assembly illustrating a carrier sub-assembly with a locking bar disposed in a locking position to lock the plug assembly in a lock cylinder body.

To assemble the lock cylinder 10, the pins 113 and spring 115 are disposed in the channels 74 of the plug body 40. The spring-retaining cap 82 is placed in the recess 80, with the cap retaining tips 152 disposed in the alignment openings 154 and the spring alignment tips 146 engaged with the springs 115. The carrier sub-assembly 42 is assembled by placing the racks 92 into the slots 103 and the spring-loaded locking bar 94 into the locking bar recess 106, with the gear teeth 136 engaging the locking bar-engaging grooves 132 formed in the racks 92. The spring catch 96 is disposed in the spring catch recess 108 of the carrier 90. A valid key 160 is inserted into the keyway 52, the return spring 98 is compressed into the return spring recess 112, and the carrier sub-assembly is placed adjacent the plug body 40, as illustrated in FIG. 3. The plug assembly 14 is placed in the lock cylinder body 12 and the retainer 16 is disposed in the slots 66 formed in the plug body 40 to retain the plug assembly 14 in the cylinder body 12. The lock cylinder 10 is now keyed to the valid key 160.

Figure 4:
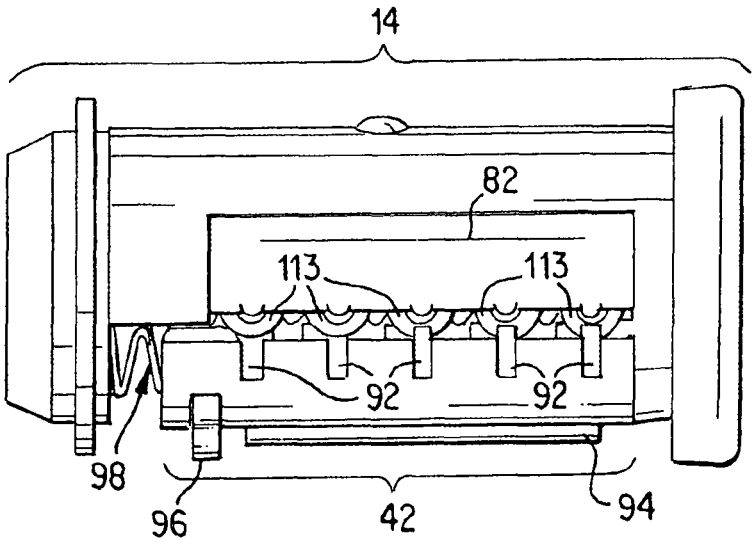
FIG. 4 is a top plan view of the plug assembly of FIG. 3.
Figure 5:
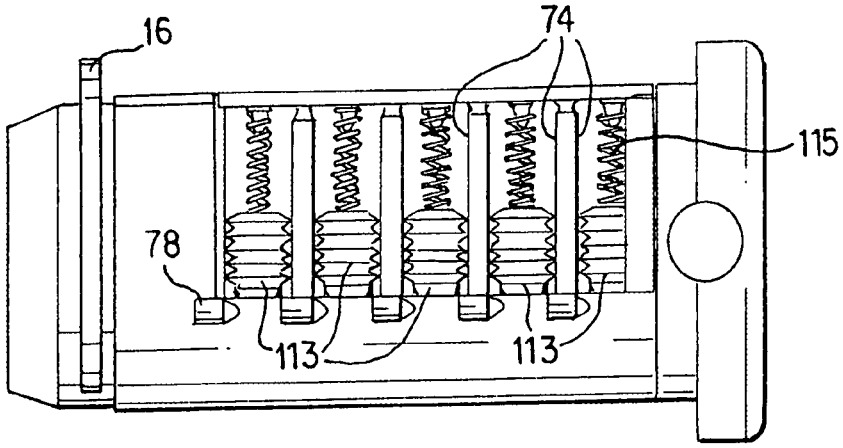
FIG. 5 is a partially broken away side view of the plug assembly of FIG. 3.

The properly keyed lock cylinder 10, without the key 160 inserted, is illustrated in FIGS. 4-7. The pins 113 are biased to the bottom of the channels 74 and, based on the cut of the key 160, the racks 92 are disposed at various positions in the slots 103 of the carrier 90. In this configuration, the locking bar 94 extends from the carrier 90 to engage the groove 29 in the cylinder body 12 to prevent the plug assembly 14 from rotating in the cylinder body 12 and the racks 92 engage the pins 113, as illustrated in FIG. 4. In addition, the bullet-shaped features 78 are misaligned with the groove 111 in the racks 92 and therefore interfere with movement of the racks 92 parallel to the longitudinal axis of the lock cylinder 10, preventing the lock cylinder 10 from being rekeyed.

Figure 8:
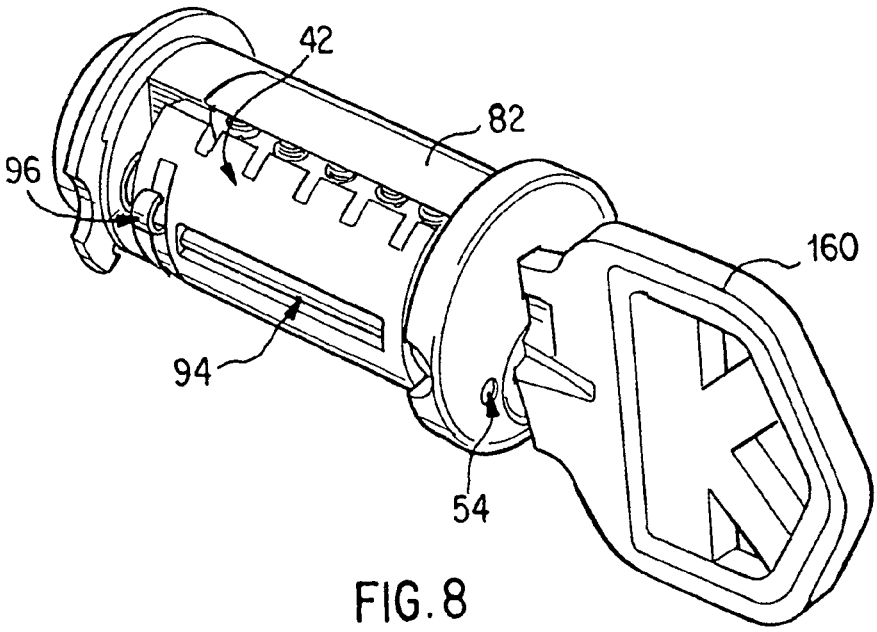
FIG. 8 is a perspective view of the plug assembly of FIG. 3 with a valid key inserted therein and illustrating the locking bar disposed in an unlocking position to allow the plug assembly to rotate in the lock cylinder body.
Figure 9:
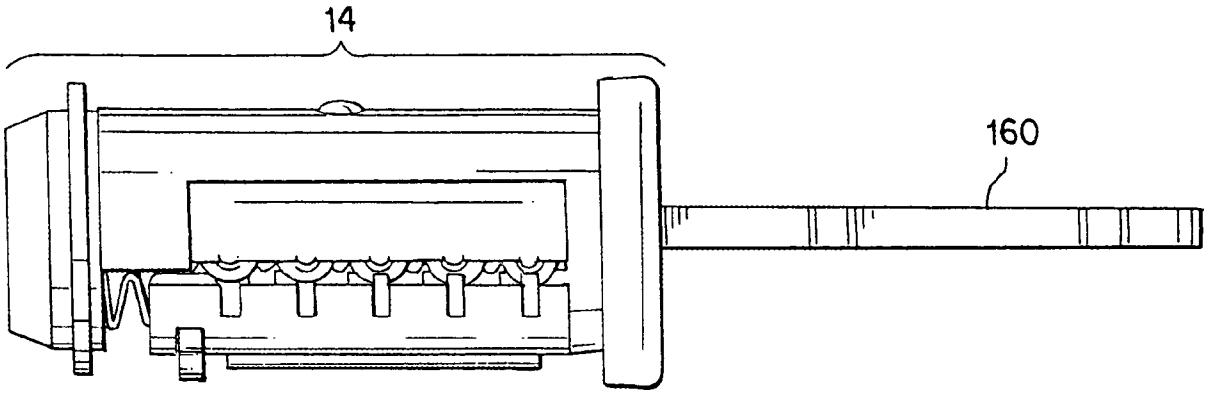
FIG. 9 is a top plan view of the plug assembly of FIG. 8.

The internal configuration of a lock cylinder 10 with the valid key 160 inserted therein at the home position is illustrated in FIGS. 8-12. In this configuration, the locking bar 94 is free to cam out of the groove 29 in the cylinder body 12, as depicted in FIGS. 8, 9 and 12. The bits of the key 160 lift the pins 113 in the channels 74 and thereby re-position the racks 92 in the slots 103. When repositioned, the racks 92 are disposed to align the locking bar-engaging grooves 132 with the extended gear teeth 136 on the locking bar 94. The locking bar 94 is free to cam out of the groove 29 as the key 160 is rotated. At the same time, the bullet-shaped features 78 are aligned with the groove 111 in the racks 92, as illustrated in FIG. 12, allowing the racks 92, and the carrier 90, to move parallel to the longitudinal axis of the lock cylinder 10.

Figure 13:
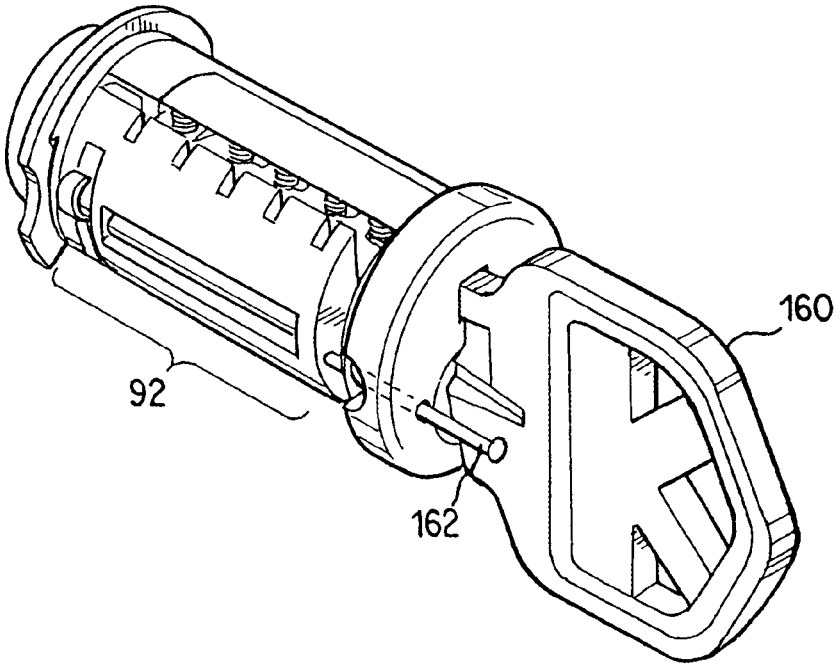
FIG. 13 is a perspective view similar to FIG. 8 but with the carrier assembly moved axially to a rekeying position.
Figure 14:
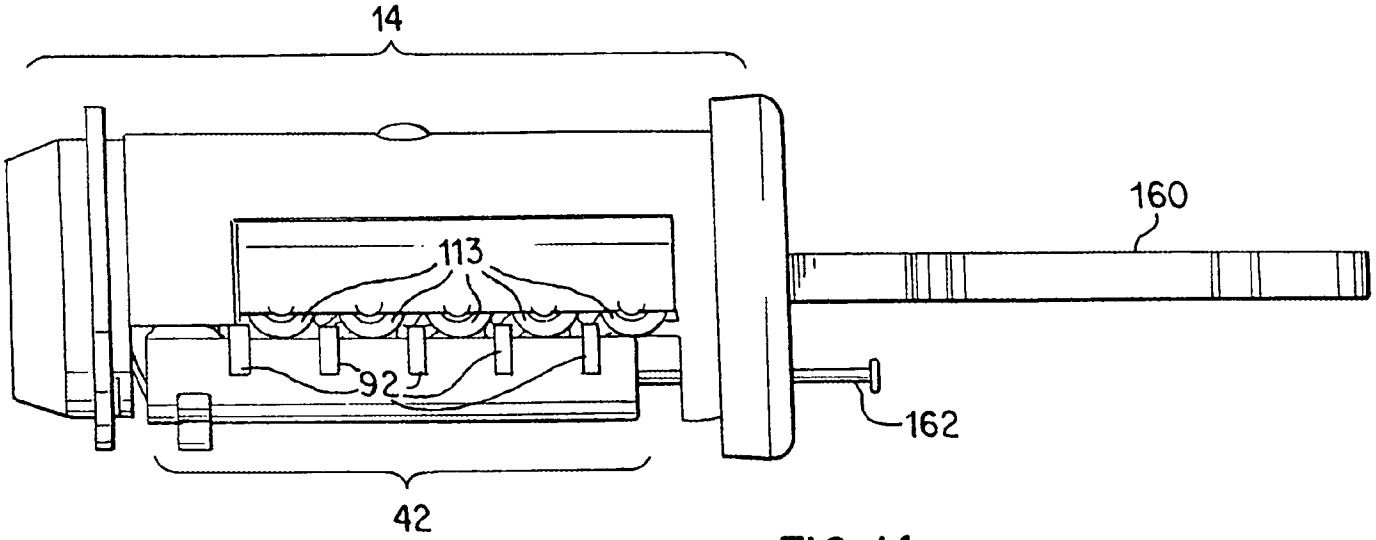
FIG. 14 is a top plan view of the plug assembly of FIG. 13.
Figure 15C:
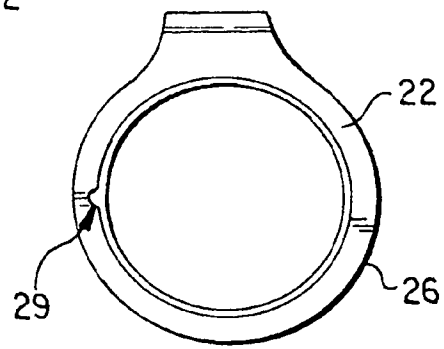
FIGS. 15*a*-15*e* are various views of a cylinder body for use in the present invention.
Figure 15B:
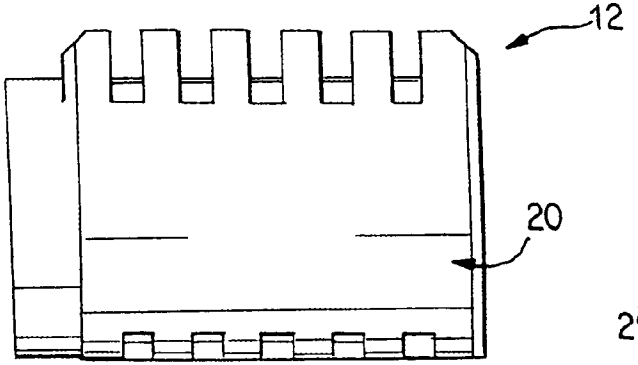
Figure 15A:
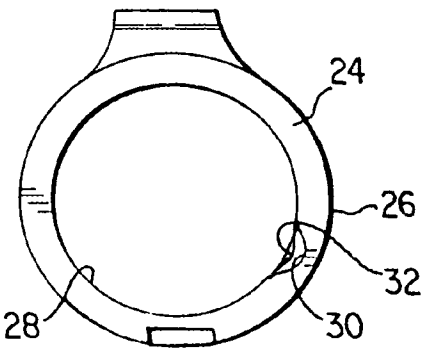
Figure 15E:
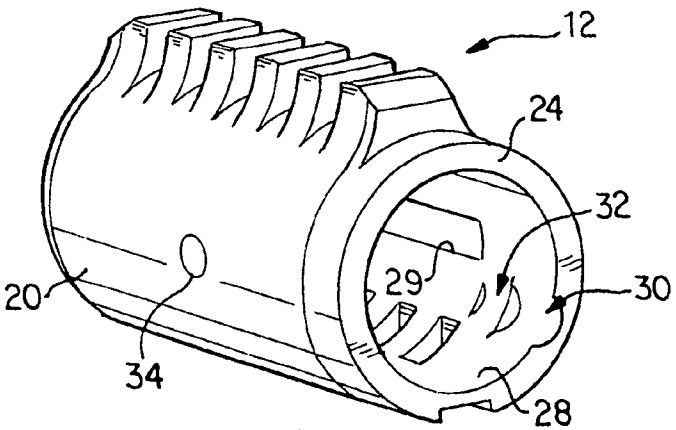
Figure 15D:
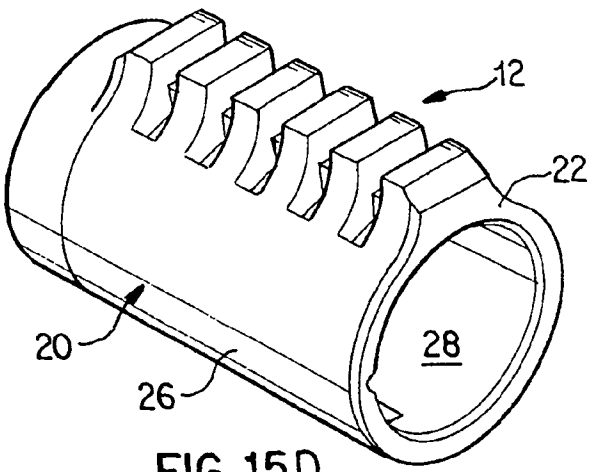
Figure 16A:
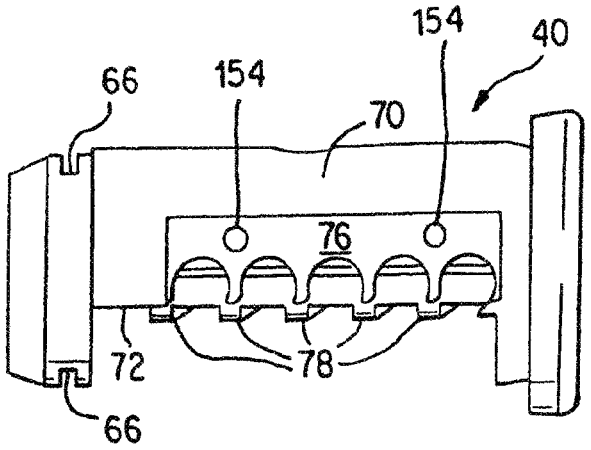
Figure 16B:
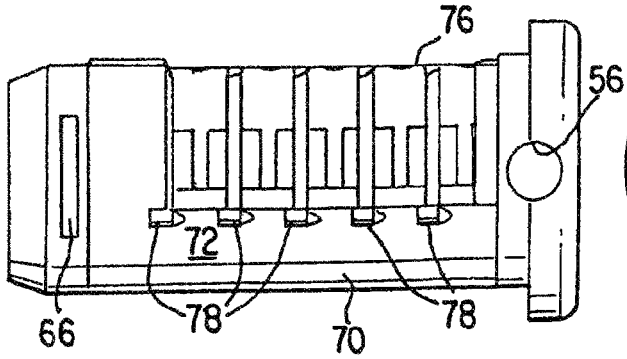
Figure 16C:
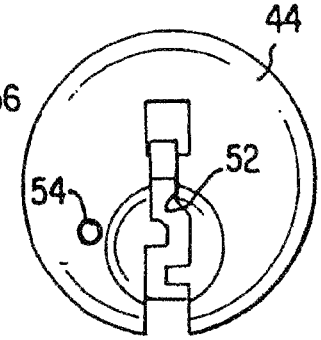

To rekey the lock cylinder 10, the valid key 160 is inserted into the keyway 52, as illustrated in FIGS. 13-14 and rotated approximately 45° counterclockwise from the home position until the spring catch 96 moves into the second detent recess 32 formed in the cylinder body 12. A paperclip or other pointed device 162 is inserted into the tool opening 54 and pushed against the carrier 90 to move the carrier 90 parallel to the longitudinal axis of the lock cylinder 10 until the spring catch 96 moves into the first detent recess 30, and the pointed device 162 is removed. With the spring catch 96 disposed in the first detent recess 30, the racks 92 are disengaged from the pins 113, as illustrated in FIG. 14. The valid key 160 is removed and a second valid key is inserted and rotated clockwise to release the spring catch 96. As the spring catch 96 leaves the first detent recess 30, the carrier 90 is biased toward the plug face 44 by the return spring 98, causing the racks 92 to re-engage the pins 113. At this point, the lock cylinder 10 is keyed to the second valid key and the first valid key 160 no longer operates the lock cylinder 10. The lock cylinder 10 can be rekeyed to fit a third valid key by replacing the first and second valid keys in the above procedures with the second and third valid keys, respectively.

Figure 23:
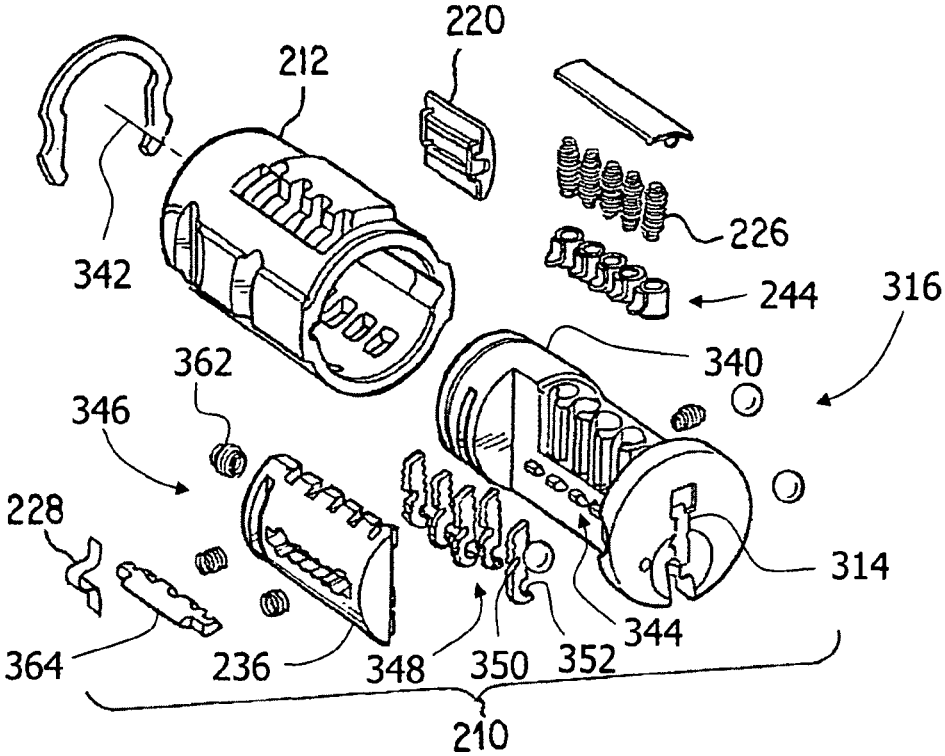
FIG. 23 is an exploded perspective view of an alternative embodiment of the invention.
Figure 24A:
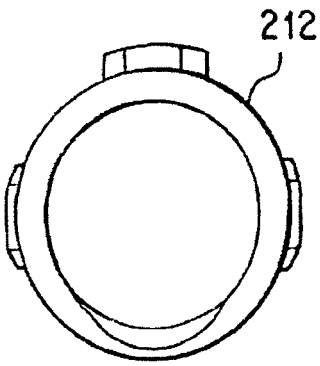
FIGS. 24*a*-24*e* are views of an alternative embodiment of the lock cylinder housing.
Figure 24B:
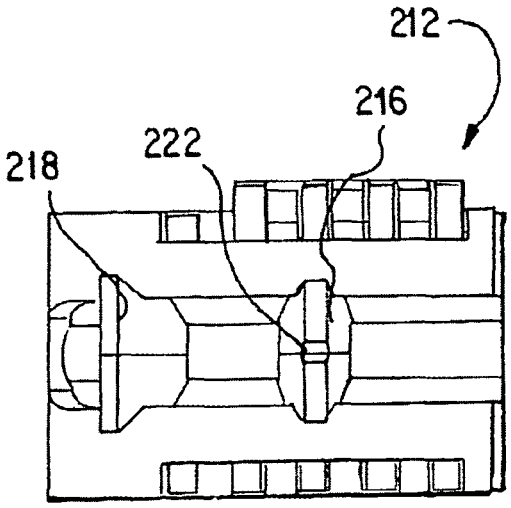
Figure 24C:
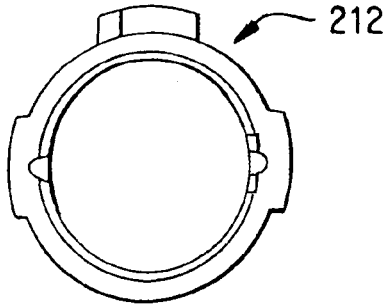
Figure 24D:
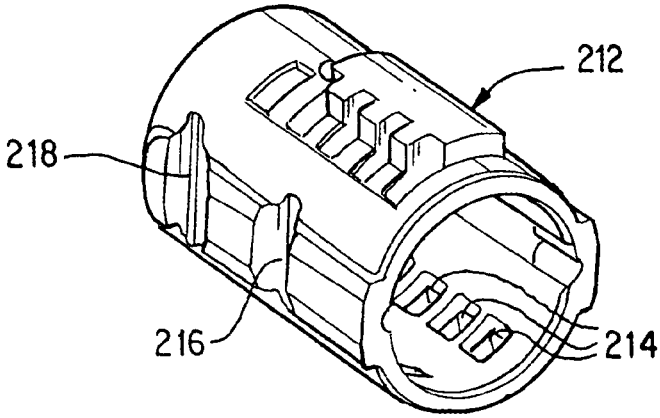
Figure 24E:
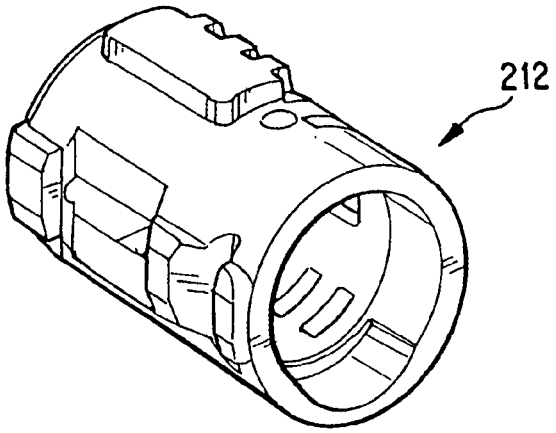

An alternative embodiment 210 of the invention is illustrated in FIGS. 23-29. The alternative embodiment includes the same components, as illustrated in FIG. 23, but several of the components have been modified. Functionally, both embodiments are the same.

The modified housing 212, illustrated in FIGS. 23 and 24, includes a plurality of apertures 214 running longitudinally along the bottom thereof and a pair of vertical grooves 216, 218 formed in the housing sidewall. In addition, the sidewall includes a removable side panel 220. The rectangular holes 214 are positioned to allow the use of a manual override tool. The center groove 216 includes an aperture 222 extending through the housing sidewall. The aperture 222 allows a user to move the locking bar during a manual override operation. The side panel 220 provides access for performing certain operations while changing the master key of the lock cylinder.

Figure 25:
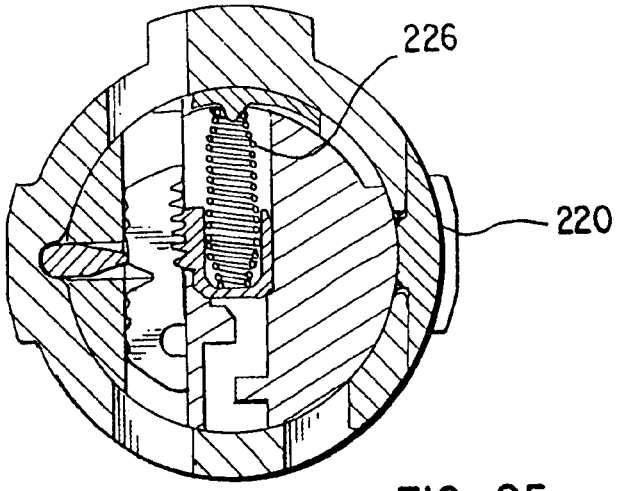
FIG. 25 is a transverse section view taken through an alternative embodiment of the present invention.

The modified pin biasing springs 226, illustrated in FIGS. 23 and 25, include a non-constant diameter, with the last few coils at each end of the springs 226 having a reduced diameter. The tapering allows for a greater spring force in a smaller physical height.

Figure 26A:
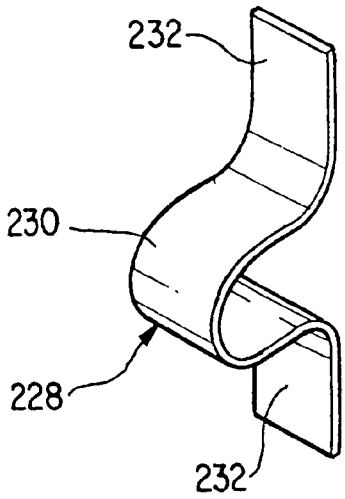
FIGS. 26*a*-26*b* are views of an alternative embodiment of the spring catch.
Figure 26B:
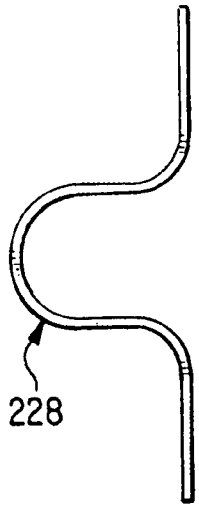
Figure 27A:
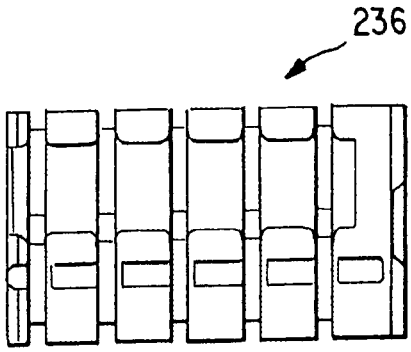
FIGS. 27*a*-27*e* are views of an alternative embodiment of the carrier.
Figure 27B:
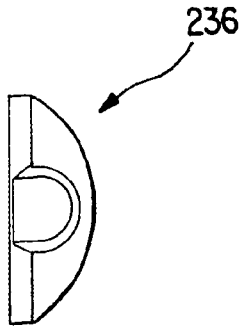
Figure 27C:
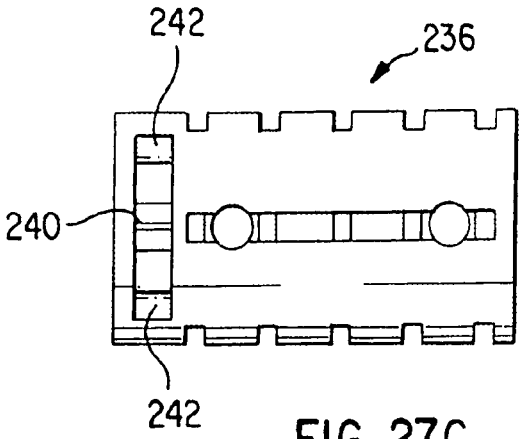
Figure 27D:
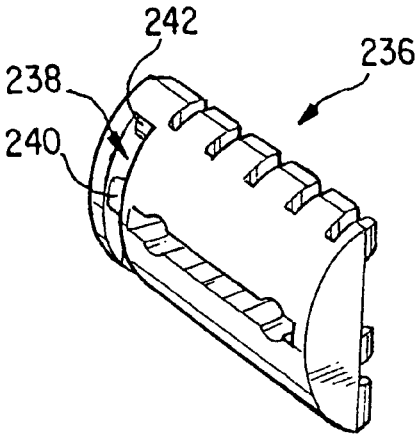
Figure 27E:
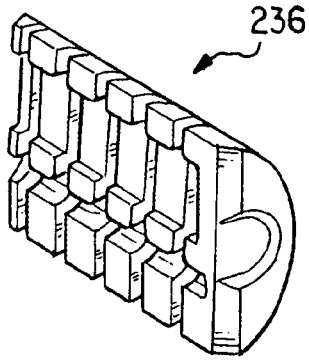

The modified spring catch 228, illustrated in FIGS. 23 and 26, includes a central U-shaped portion 230 and a pair of arms 232 extending from the U-shaped portion 230.

The modified carrier 236, illustrated in FIGS. 23 and 27, includes means for retaining the spring catch 228 in the spring catch recess 238. In the illustrated embodiment, this includes a guide 240 projecting outwardly in the center of the spring catch recess 238 and a pair of anchors 242 radially offset from the guide 240. The guide 240 prevents the spring catch 228 from moving transversely in the recess 238 while permitting it to move radially outwardly to engage the housing 12, 212 as described above. The anchors 242 engage the arms 232 of the spring catch 228 and prevent the arms 232 from splaying outwardly, thereby directing the compressive force of the spring catch 228 to extend the U-shaped portion 230 outwardly to engage the housing 12, 212.

Figure 28A:
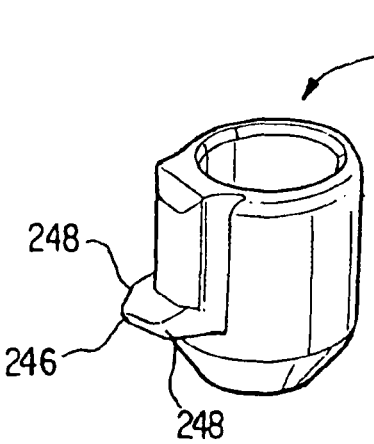
FIGS. 28*a*-28*b* are views of an alternative embodiment of the pin.
Figure 28B:
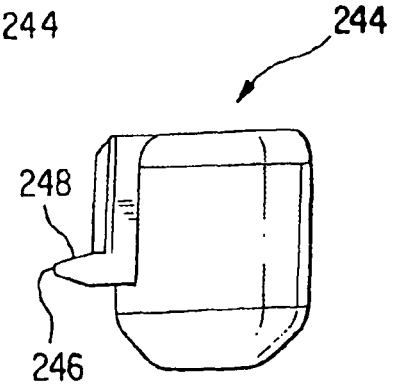

The modified pins 244, illustrated in FIGS. 23 and 28, include a single gear tooth 246 instead of the plurality of gear teeth of the pins 113 described above. The single gear tooth 246, which preferably includes beveled sides 248, provides for a smoother engagement with the racks during the rekeying process.

Figure 29A:
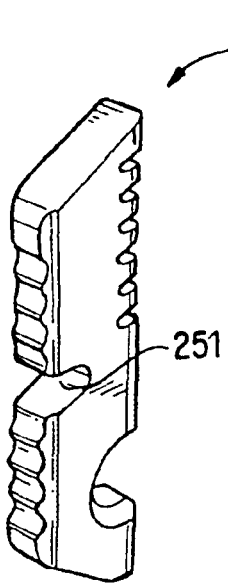
FIGS. 29*a*-29*b* are views of an alternative embodiment of the rack.
Figure 29B:
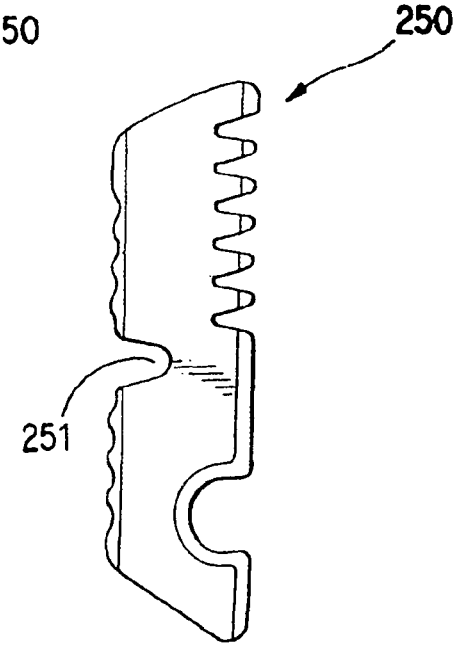

The modified racks 250, illustrated in FIGS. 23 and 29, include beveled gear teeth to improve the engagement with the pins during the rekeying process. In addition, the pair of locking bar-engaging grooves 132 in the racks 92 are replaced with a single locking bar-engaging groove 251.

Figure 30A:
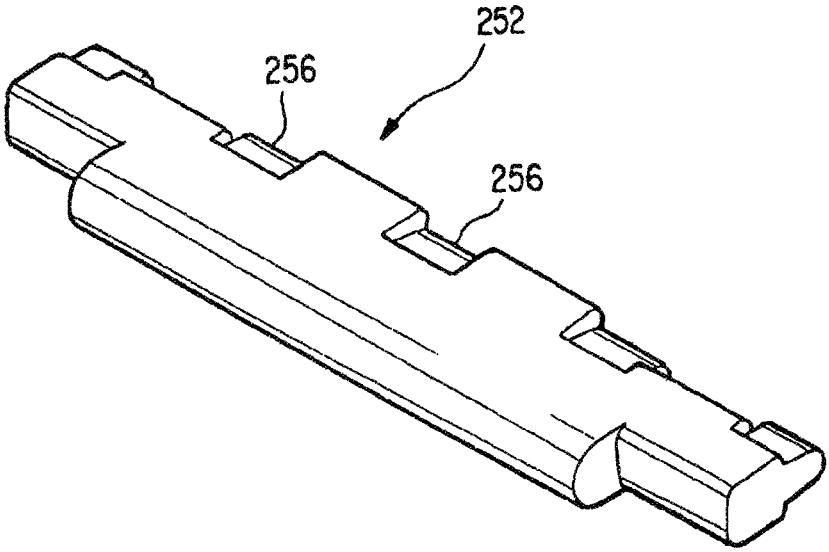
FIGS. 30*a*-30*b* are views of an alternative embodiment of the locking bar.
Figure 30B:
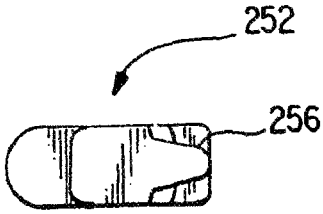

The modified locking bar 252, illustrated in FIGS. 23 and 30, is thinner than locking bar 94 and replaces the pair of gear teeth 136 with a single gear tooth 256 and rounds out the triangular edge 134. The thinner design reduces any rocking of the locking bar 252 in the locking bar recess 106.

A kit may be provided that facilitates the rekeying of a lock cylinder with respect to a master keying system. The kit may include, for example, a rack carrier moving tool 162, such as an elongate pin, e.g., a straightened portion of a paper clip, for moving a rack carrier, such as for example carrier 236, in a longitudinal direction of the lock cylinder, such as that of the lock cylinder 210 of the alternative embodiment. Alternatively, the rack carrier moving tool 162 may be provided by the user.

Figure 31:
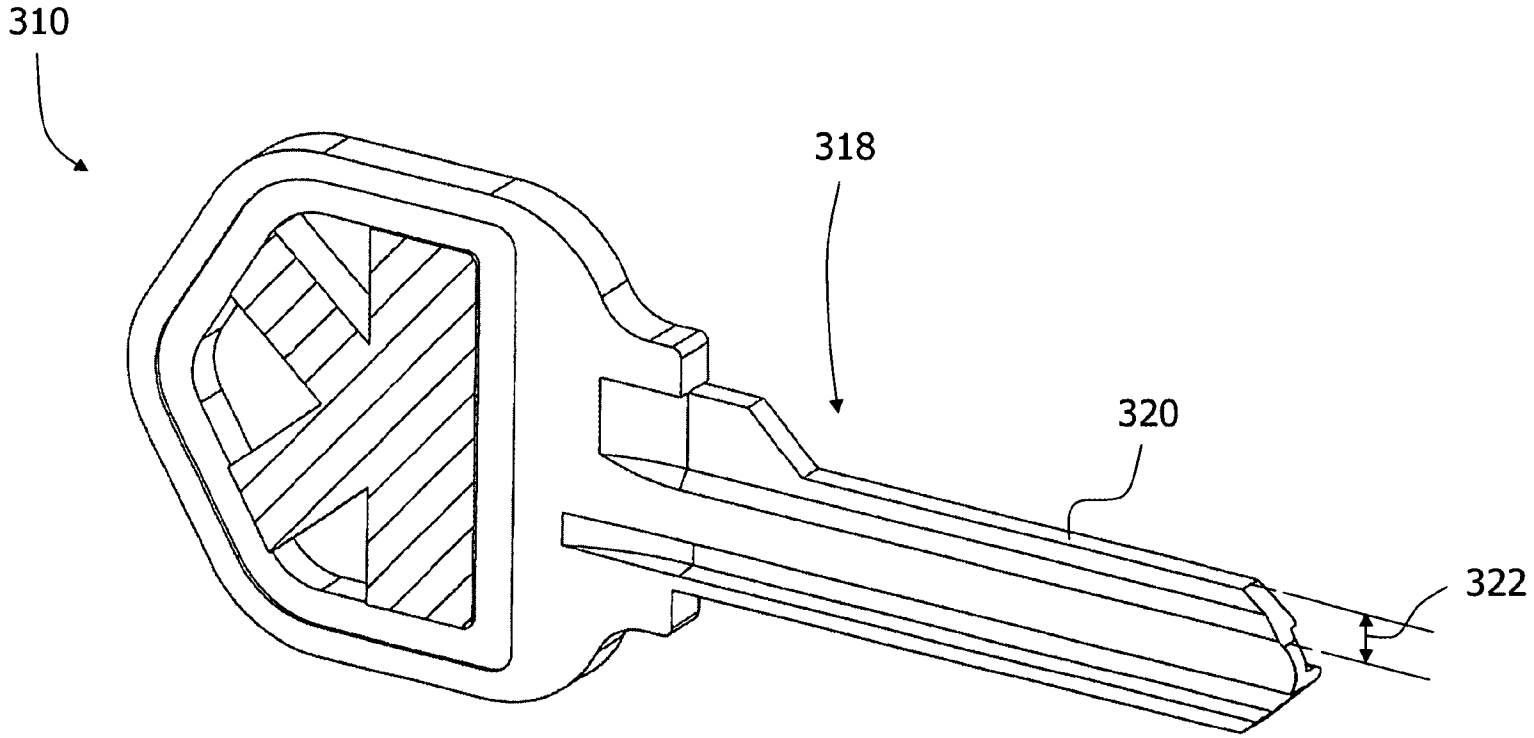
FIG. 31 shows a rack removal key in accordance with the present invention.
Figure 32:
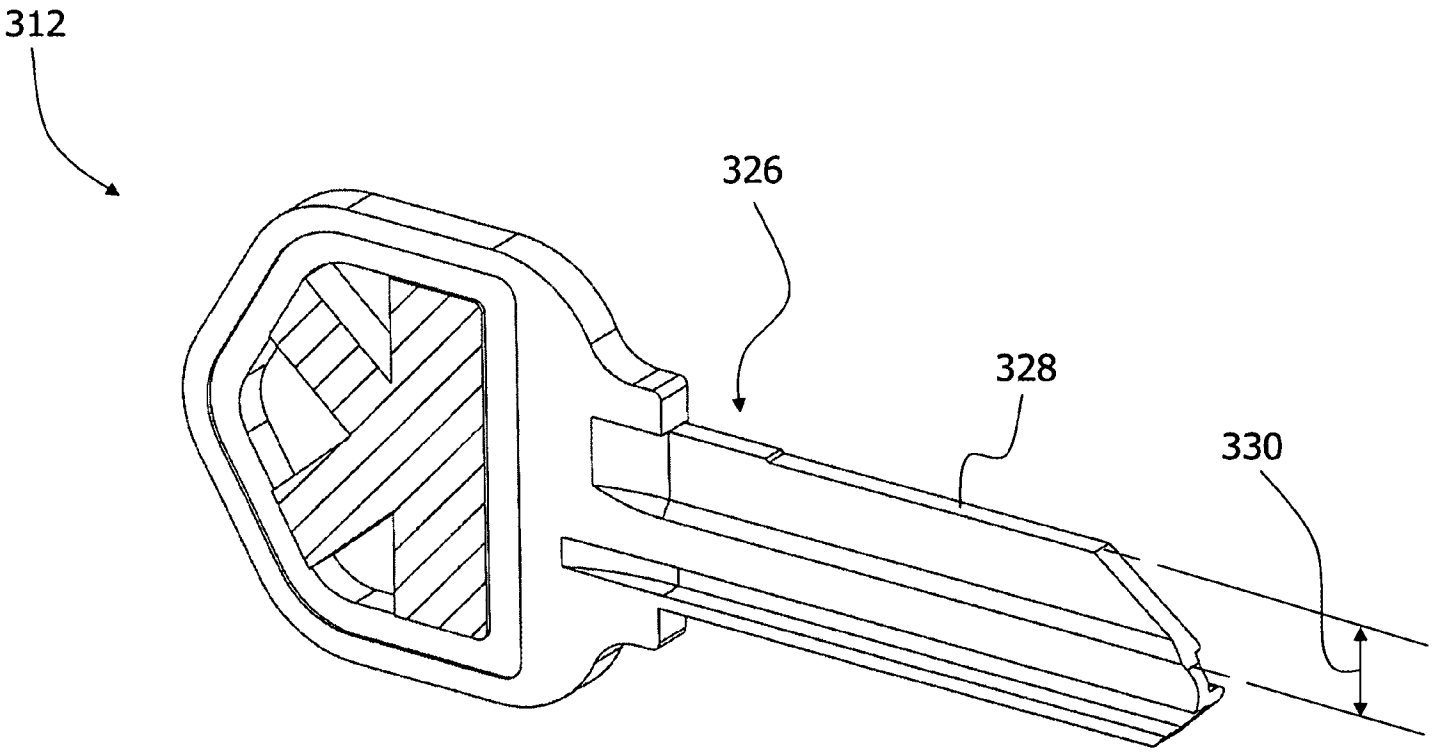
FIG. 32 shows a rack removal tool in accordance with the present invention.

The kit includes a rack removal key 310 (shown in FIG. 31) and a rack removal tool 312 (shown in FIG. 32). The rack removal key 310 is configured for insertion into a keyway, such as the keyway 314 of the plug assembly 316 shown in FIG. 33. The rack removal key 310 has a first cut 318 defining a surface 320 having a first lift amount 322 for lifting the pins, e.g., pins 244, and in turn, the racks, e.g., racks 250, which may be installed in the lock cylinder 210, and more precisely, installed in the plug assembly 316. The rack removal tool 312 is also configured for insertion into the keyway 314. The rack removal tool 312 has a second cut 326 defining a surface 328 having a second lift amount 330 for lifting the pins, e.g., pins 244, and in turn, the racks, e.g., racks 250, which may be installed in the lock cylinder 210, and more precisely, installed in the plug assembly 316. The second lift amount 330 of the rack removal tool 312 is greater than the first lift amount 322 of the rack removal key 310.

Figure 34:
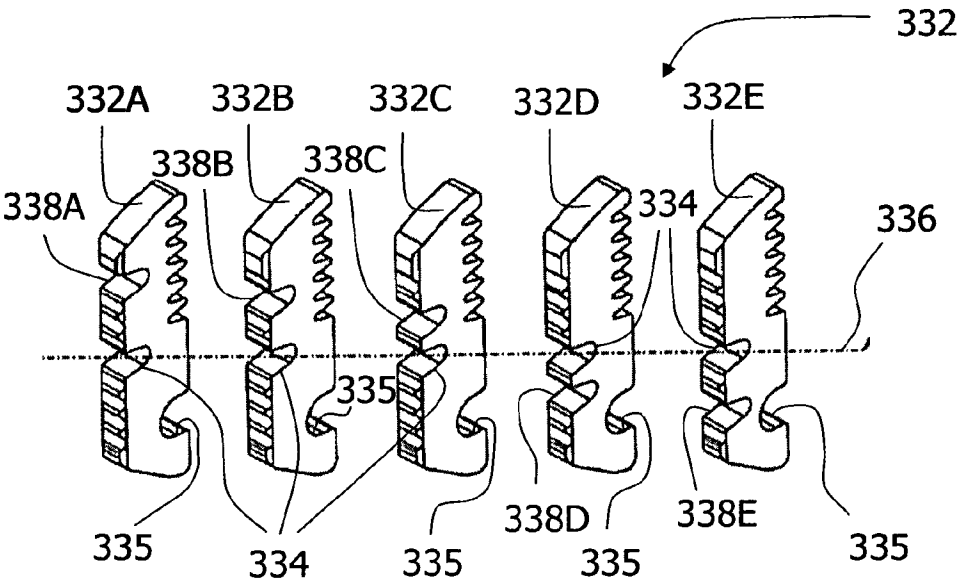
FIG. 34 shows a plurality of master racks in accordance with the present invention.

Referring to FIG. 34, the kit further includes a plurality of master racks 332, which may be replacement master racks, including, for example, individual master racks 332A-332E. In the embodiments shown, each master rack of the plurality of master racks 332 has a first locking bar-receiving groove 334. The first locking bar-receiving groove 334 is located along a neutral axis 336. At least a second locking bar-receiving groove 338A, 338B, 338C, 338D, 338E, respectively, may be variously spaced from the neutral axis 336. Also, each master rack of the plurality of replacement master racks has a protrusion groove 335 for receiving the protrusion features, e.g., rack engaging features, 344, on the plug body 340 of the plug assembly 316 (see FIG. 23), and which are spaced a common distance from neutral axis 336. The configuration of the plurality of master racks 332, and the various spacing of the second locking bar-receiving grooves, e.g., 338A, 338B, 338C, 338D, 338E, respectively, from the neutral axis 336 for each master rack 332A-332E may be correlated to a particular master key. The second locking bar-receiving groove 338A-338E may be anywhere above or below the first locking bar-receiving groove 334. The purpose of the second locking bar-receiving groove 338A-338E is for the master keying capability of the lock cylinder 210.

Figure 35:
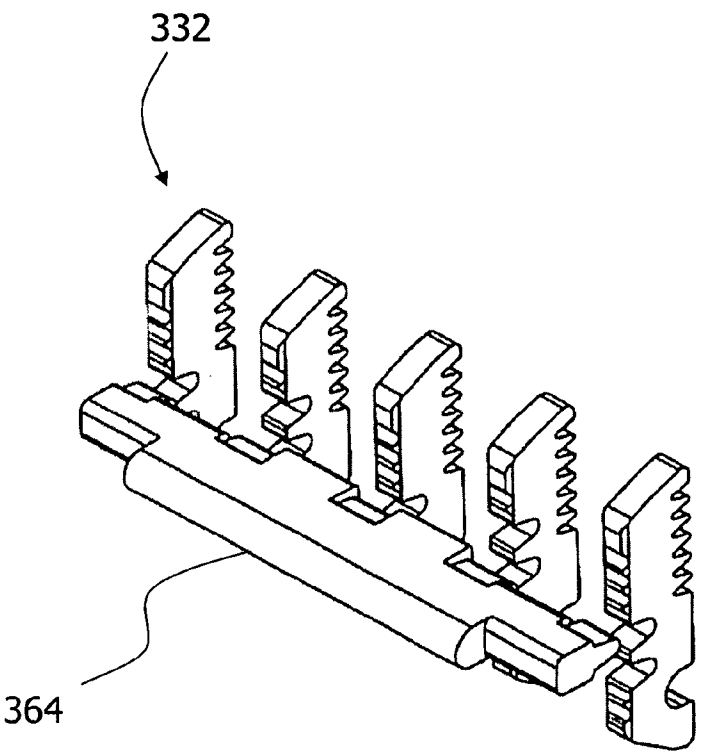
FIG. 35 shows the position of the plurality of master racks when a tenant key is inserted into the keyway.

FIG. 35 shows the position of the plurality of master racks 332 when a tenant key has been inserted in the keyway 314 of the plug assembly 316. The plug assembly 316 is still able to rotate in the cylinder body 212, with the locking bar 364 engaging individual grooves of the plurality of master racks 332. However, with the plurality of master racks 332 not having lined up along the neutral axis 336, the lock cylinder 210 cannot be rekeyed.

Figure 36A:
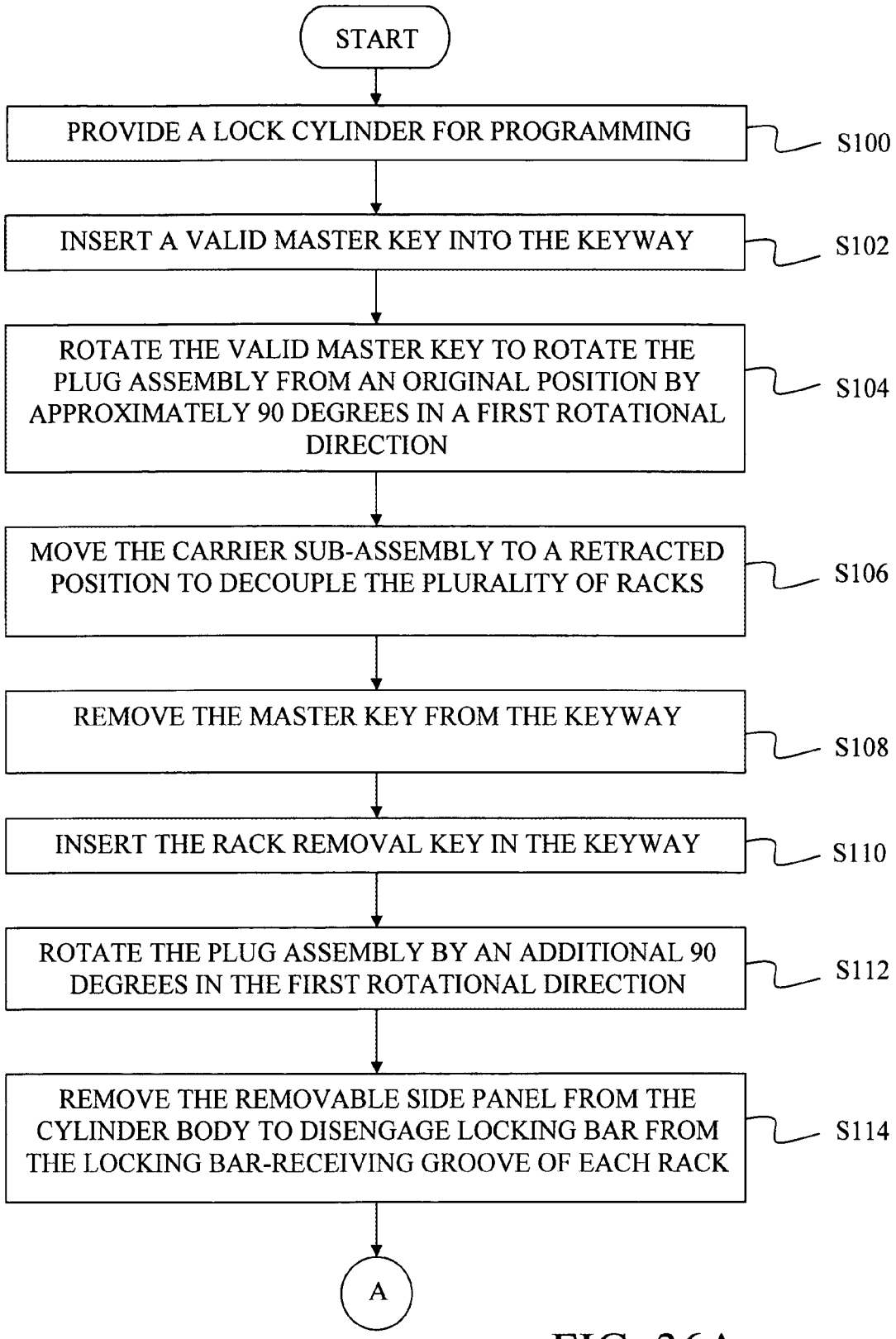
FIGS. 36A-36C show a detailed flowchart of one embodiment of a method for rekeying a lock cylinder of the master keying system in accordance with the present invention.
Figure 36B:
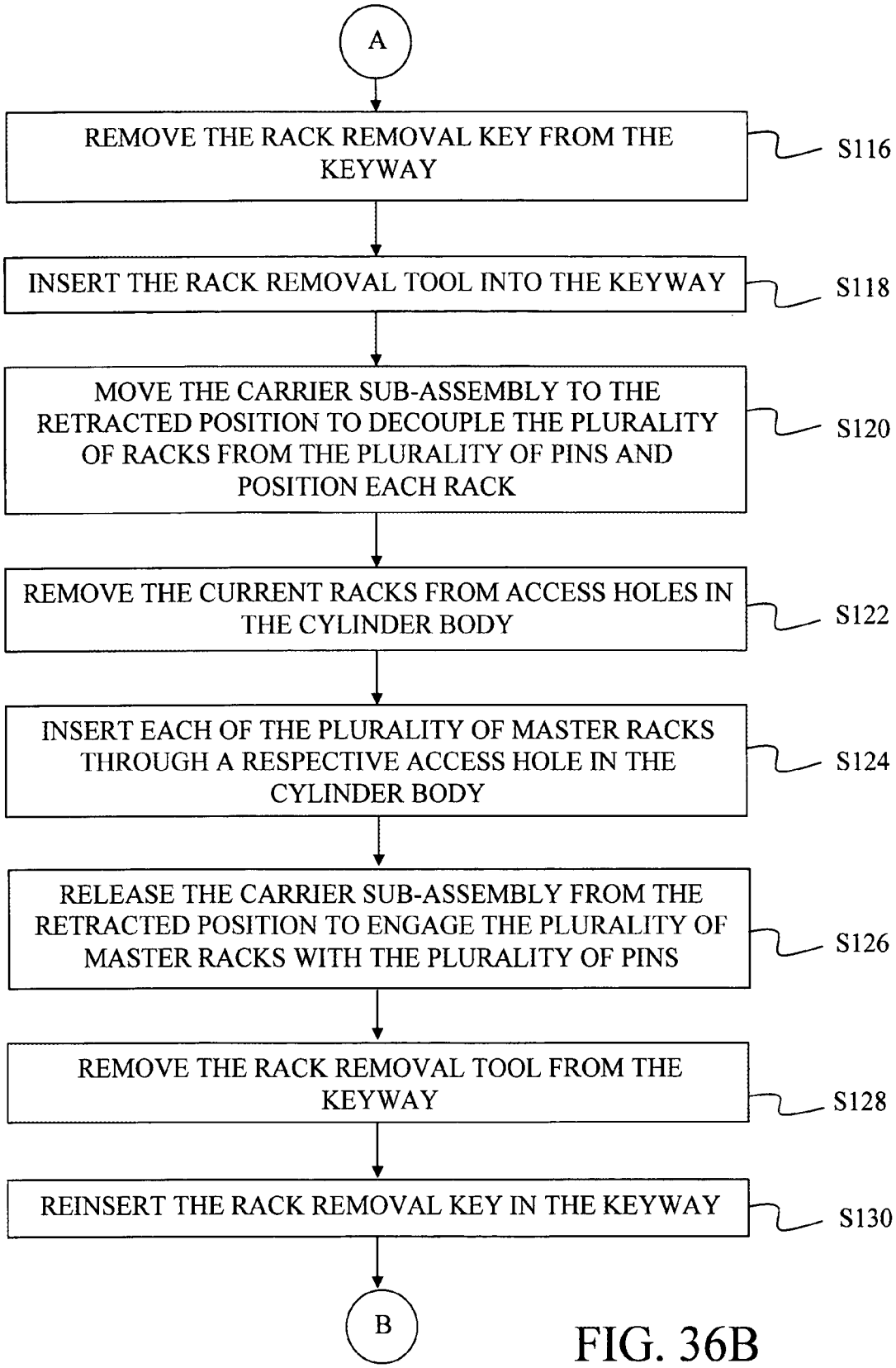
Figure 36C:
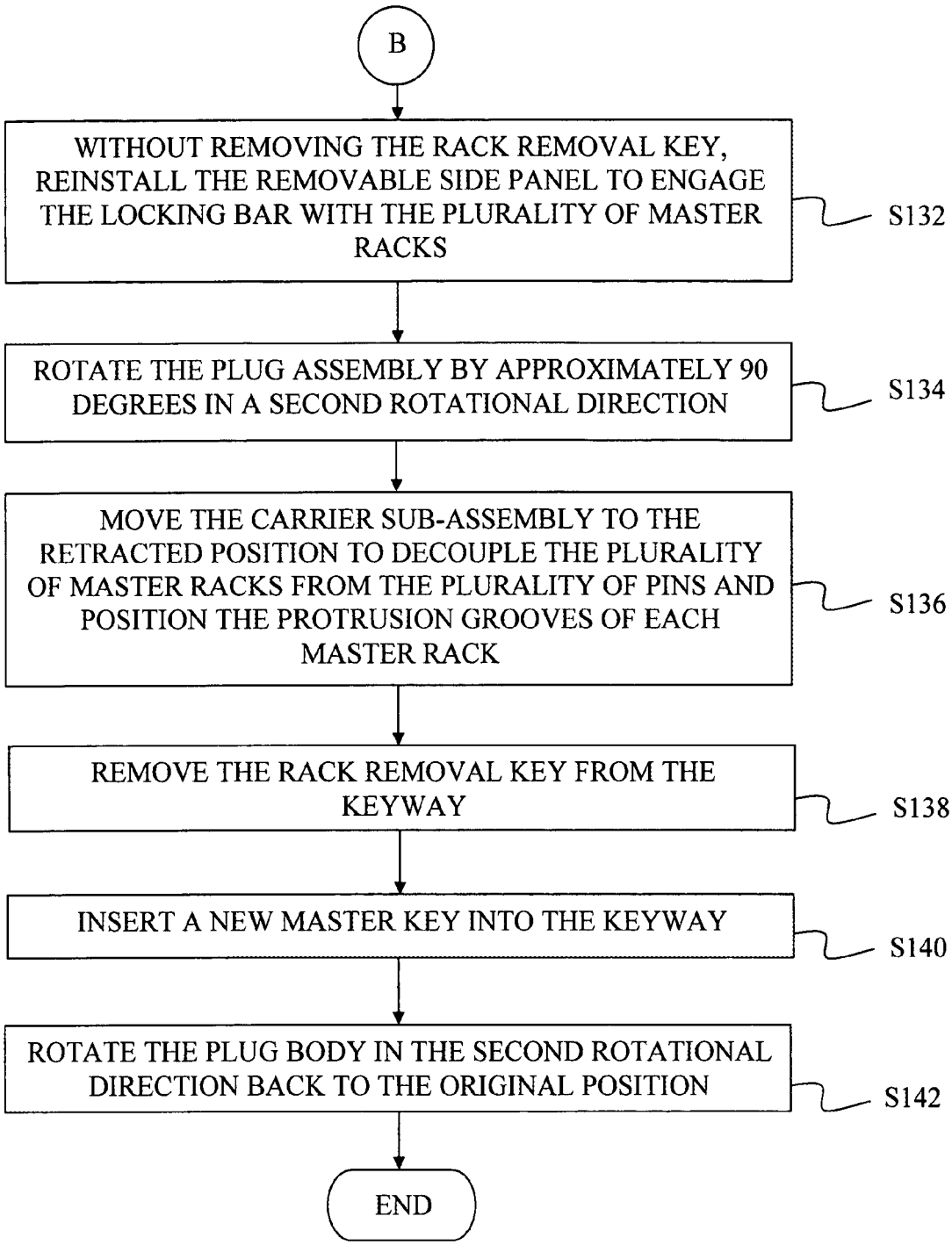

FIGS. 36A-36C show a detailed flowchart of one embodiment of a method for rekeying the lock cylinder 210 of the master keying system, which may utilize components of the kit described above in relation to FIGS. 31-35. This method will be described with further reference to FIGS. 37-52.

Figure 33:
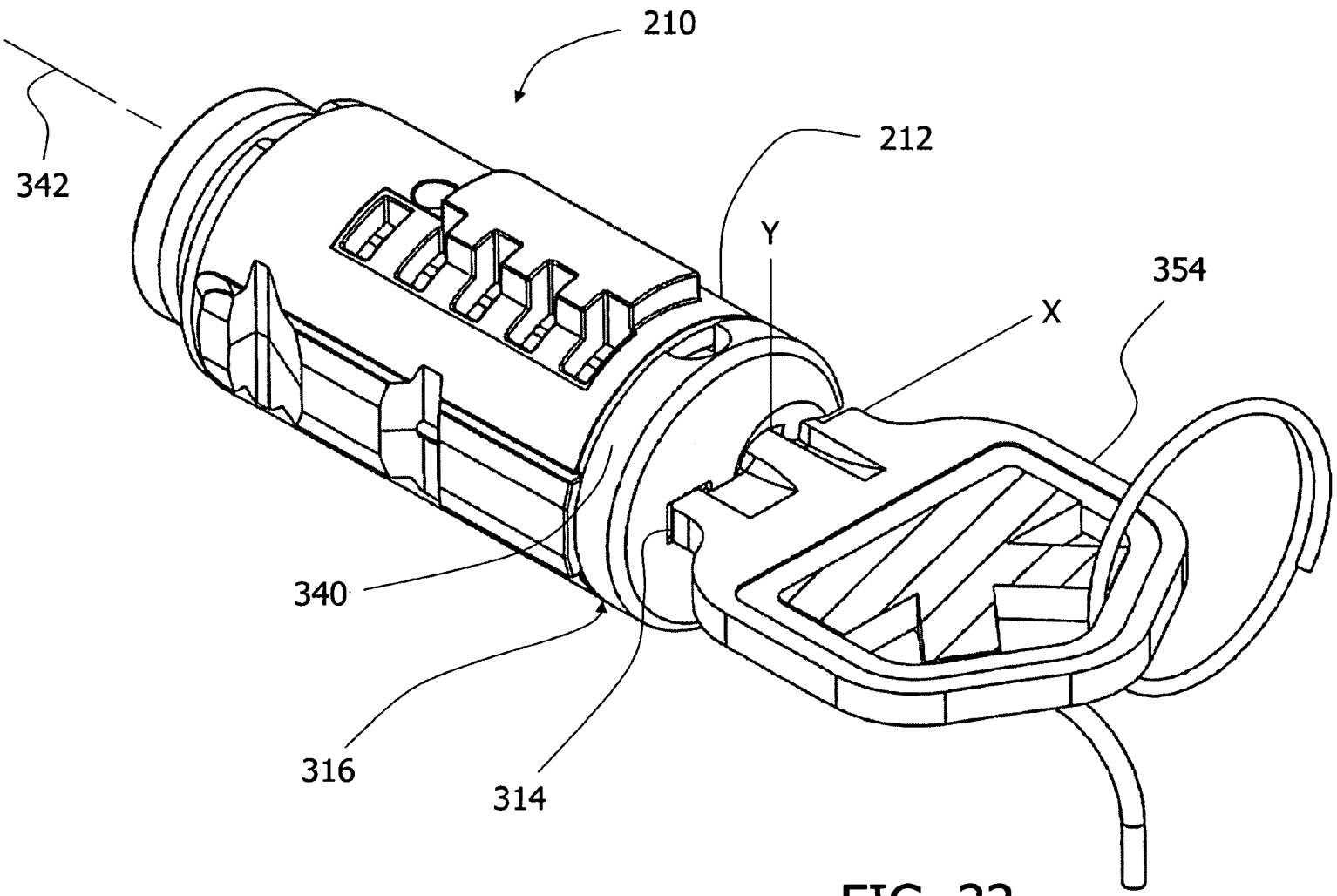
FIG. 33 shows a lock cylinder having a plug assembly and keyway.

At step S100, and with reference to FIGS. 23 and 33, a lock cylinder 210 is provided for rekeying. The lock cylinder 210 includes a cylinder body 212 with a longitudinal axis 342, and with the plug assembly 316 disposed in the cylinder body 212. The plug assembly 316 includes the keyway 314, the plug body 340 having the plurality of protrusion features 344, and a carrier sub-assembly 346 disposed adjacent the plug body 340. The carrier sub-assembly 346 is moveable parallel to the longitudinal axis 342 of the cylinder body 212 between a first position, e.g., an initial position, and a second position, e.g., a retracted position. The plug assembly 316 includes the plurality of pins 244 and the plurality of racks 348, as shown in FIG. 23, or alternatively the plurality of master racks 332, as shown in FIG. 34, for engaging the pins 244. Each rack of the plurality of racks 348 has a locking bar-receiving groove 350 and a protrusion groove 352.

At step S102, a valid master key 354 is inserted into the keyway 314.

At step S104, as depicted in FIG. 33, the valid master key 354 is rotated to rotate the plug assembly 316 from an original position along the x-axis by approximately 90 degrees in a first rotational direction, e.g., counterclockwise, respective to the X-axis.

Figure 37:
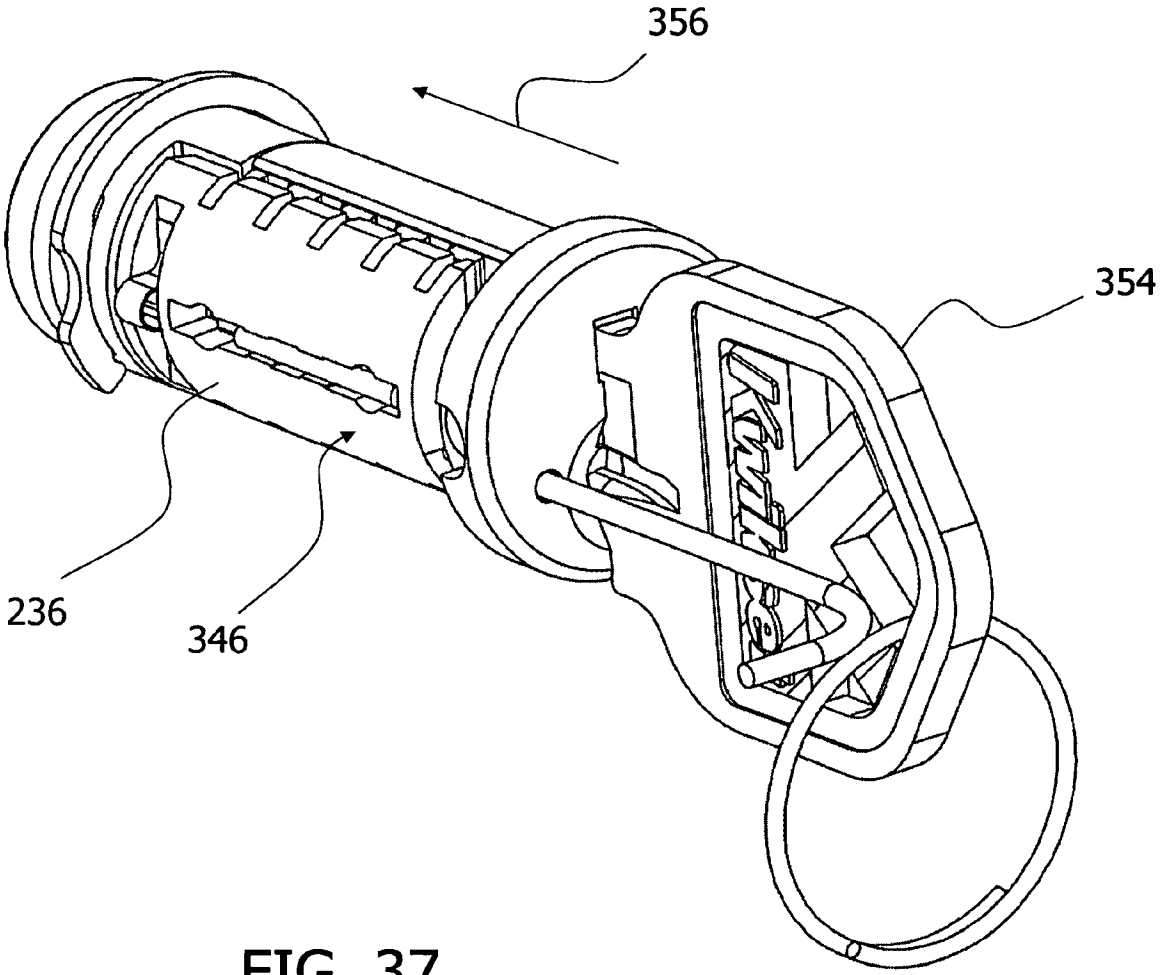
FIG. 37 shows the position of the carrier sub-assembly as it is pushed to the retracted position.
Figure 38:
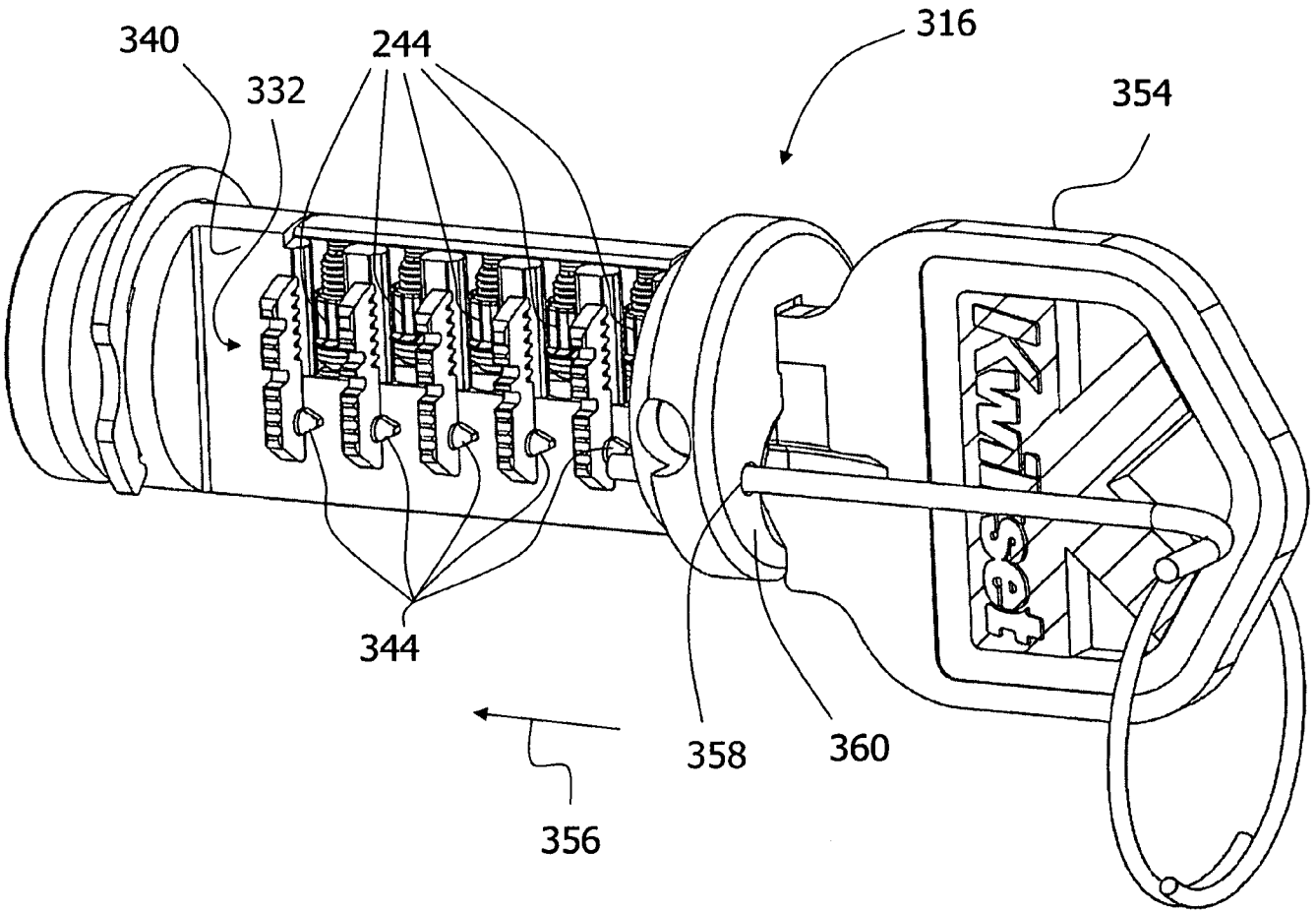
FIG. 38 shows the placement of the master racks after the carrier sub-assembly is pushed to the retracted position.

At step S106, with reference to FIGS. 37 and 38, the carrier sub-assembly 346, which includes master racks 332 in the configuration of FIG. 38, is moved in a direction 356 to a retracted position to decouple the plurality of master racks 332, as shown, from the plurality of pins 244 and position the protrusion groove 335 of each rack 332A-332E over a corresponding protrusion feature 344 (see also FIG. 34) on the plug body 340. The movement of carrier sub-assembly 346 may be effected by rack carrier moving tool 162 by inserting tool 162 into the rekeying tool opening 358 in the plug face 360 of the plug assembly 316. FIG. 37 shows the position of the carrier sub-assembly 346, which includes the plurality of master racks 332, as it is pushed backwards by tool 162 to the retracted position. FIG. 38 shows the placement of the plurality of master racks 332 after carrier sub-assembly 346 is pushed back to the retracted position. As shown, the protrusion engaging groove of each of the master racks 332 rides up over the corresponding protrusion feature 344 on the plug body 340.

Figure 39:
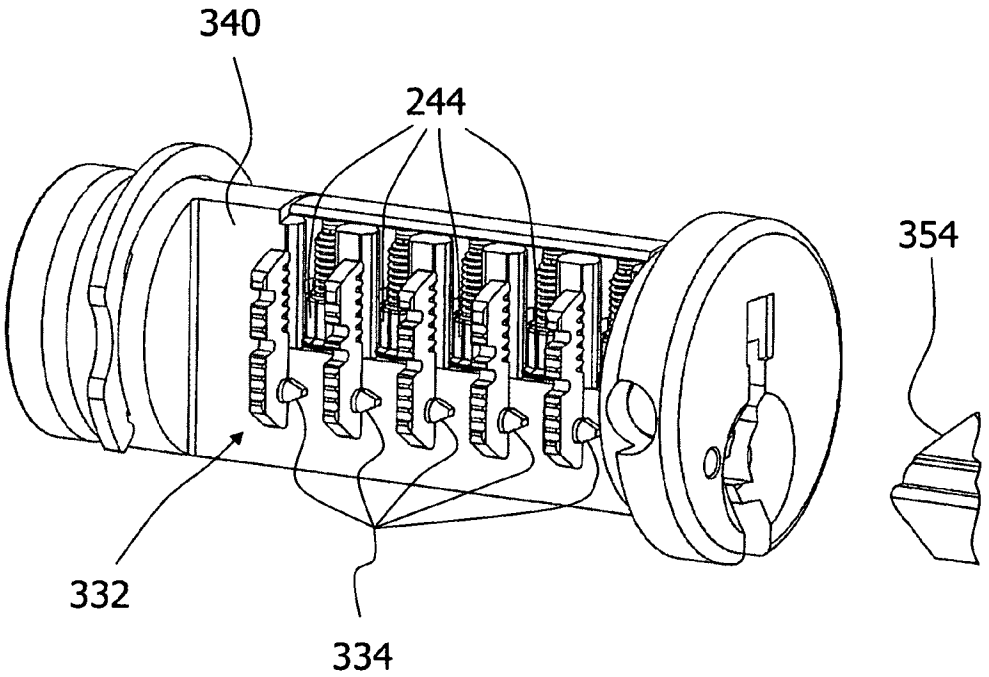
FIG. 39 shows the placement of the master racks with the master key removed from the keyway.

At step S108, the valid master key 354 is removed from the keyway 314. Referring to FIG. 39, once the master key 354 is removed, the protrusion groove 335 of each of the plurality of master racks 332 will remain over the corresponding protrusion feature 344 on the plug body 340, and the pins 244 will ride up against a ledge of the plug body 340.

Figure 40:
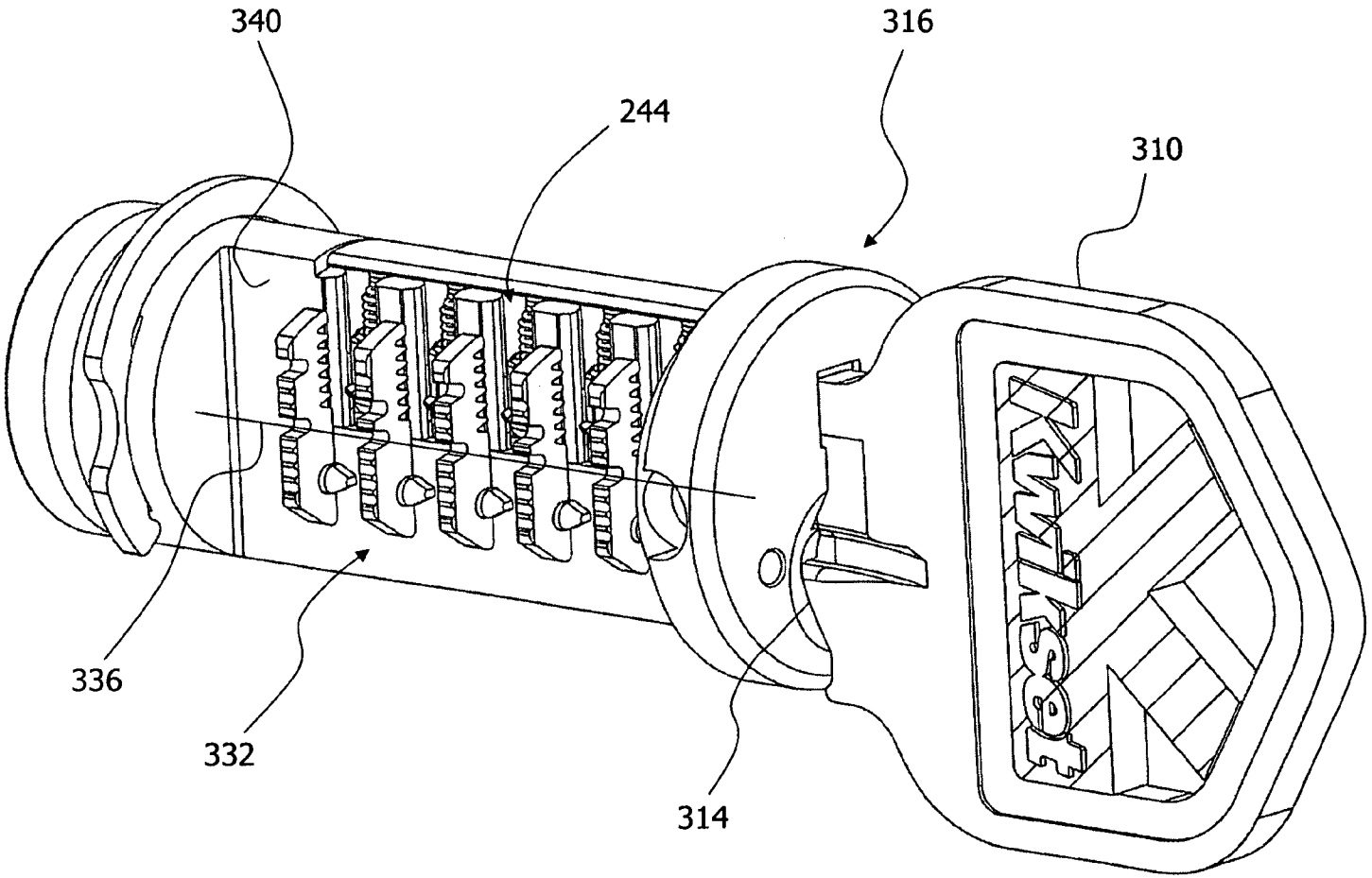
FIG. 40 shows the rack removal key inserted in the keyway of the plug assembly.
Figure 41:
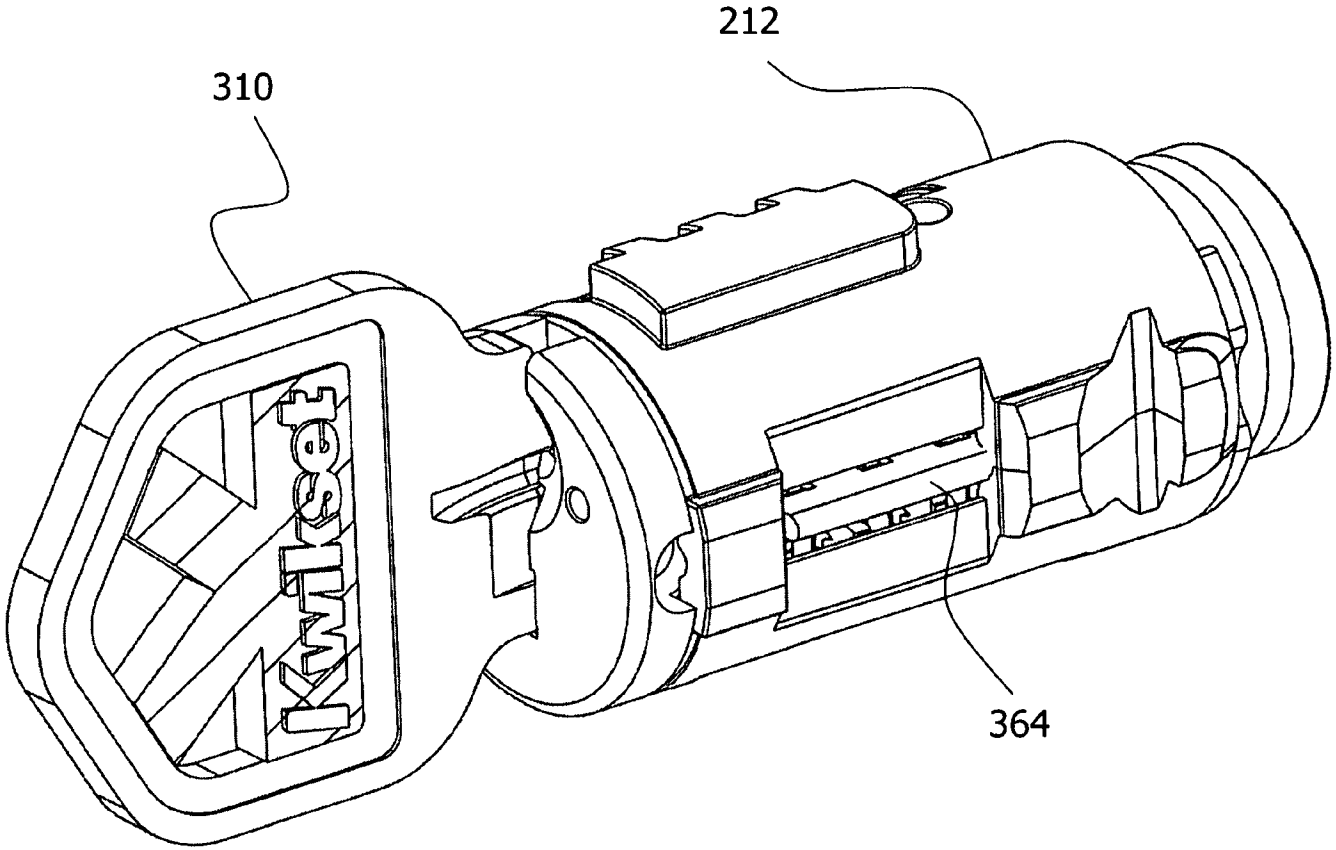
FIG. 41 shows the removable side panel removed from the cylinder body, exposing the locking bar.

At step S110, the rack removal key 310 is inserted in the keyway 314, as shown in FIG. 40. As described above, the rack removal key 310 has a cut 318 that lifts the plurality of pins 244 by a first amount, and in turn lifts the plurality of master racks 332. The relatively low cut 318 of rack removal key 310, in comparison to the cut 326 of the rack removal tool 312, is selected to locate all the racks at the neutral axis 336.

At step S112, the plug assembly 316 is rotated by an additional 90 degrees in the first rotational direction, e.g., counterclockwise, by a corresponding rotation of the rack removal key 310, so as to release the carrier sub-assembly 346 from the retracted position to reengage the plurality of master racks 332 with the plurality of pins 244. For example, as shown in FIG. 23, the plug catch 228 disengages from the slot (not shown) on the cylinder body 212 allowing the carrier spring 362 to push the carrier 236 of the carrier sub-assembly 346 forward to the first position, e.g., the initial position. As a result, in the present embodiment, the plurality of master racks 332 are reengaged with the tooth, or teeth, of the respective plurality of pins 244.

Figure 42:
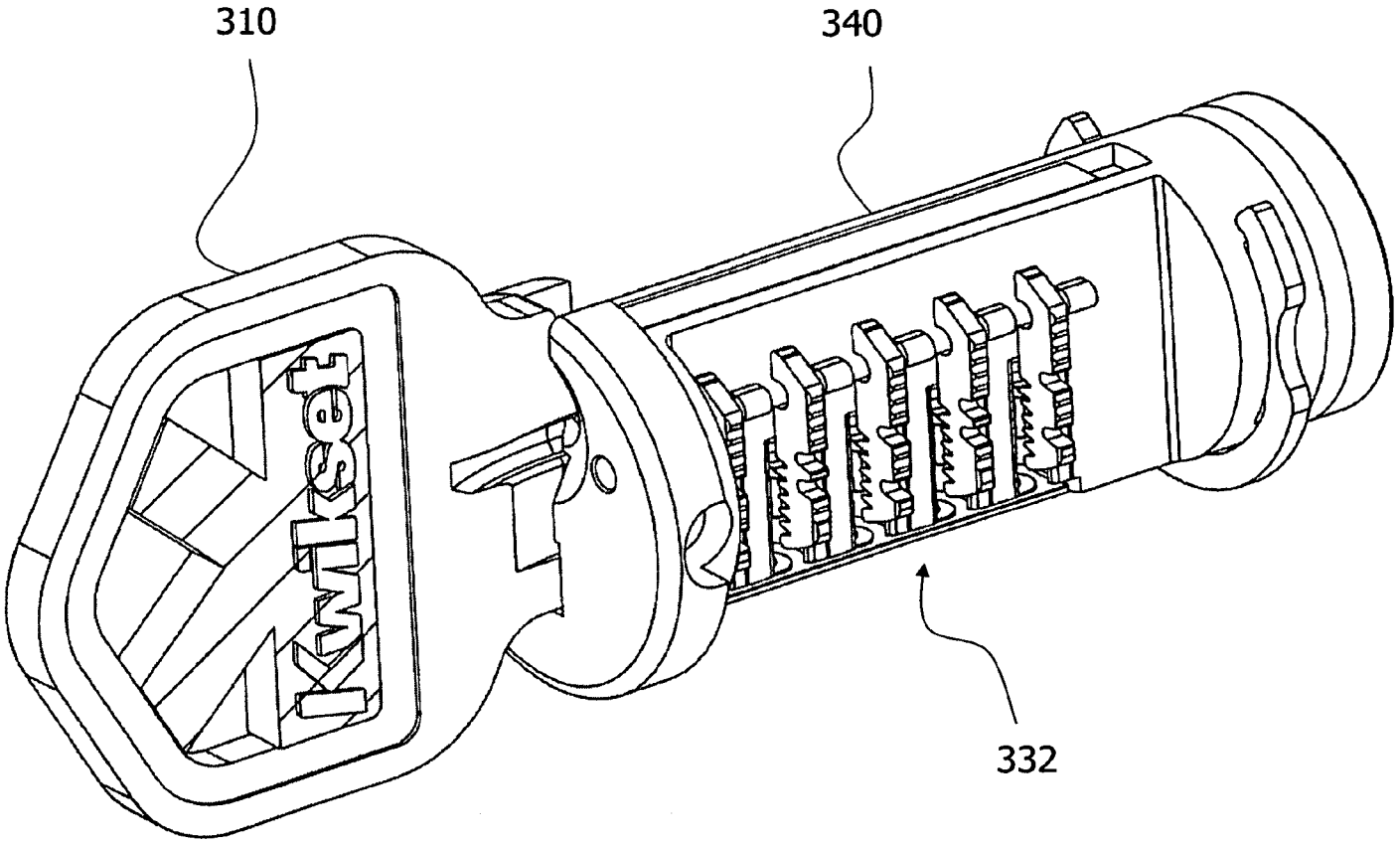
FIG. 42 shows the position of the plurality of master racks with the rack removal key inserted in the keyway.

At step S114, a removable side panel 220 is removed (see FIG. 23) from the cylinder body 212 to disengage the locking bar 364 (see FIG. 41) from the locking bar-receiving groove of each rack 332A-332E, thereby decoupling all of the plurality of master racks 332 from each other rack. The position of the plurality of master racks 332 is as shown in FIG. 42.

At step S116, the rack removal key 310 is removed from the keyway 314.

At step S118, the rack removal tool 312 is inserted into the keyway 314. As described above, the rack removal tool 312 has a cut 326 that lifts the plurality of pins 244 by a second amount greater than the first amount associated with the cut 318 of the rack removal key 310. The rack removal tool 312 lifts the plurality of master racks 332 to a position such that the entirety of the plurality of master racks 332, including the protrusion grooves 335, will be above the protrusion features 344 on the plug body 340.

Figure 43:
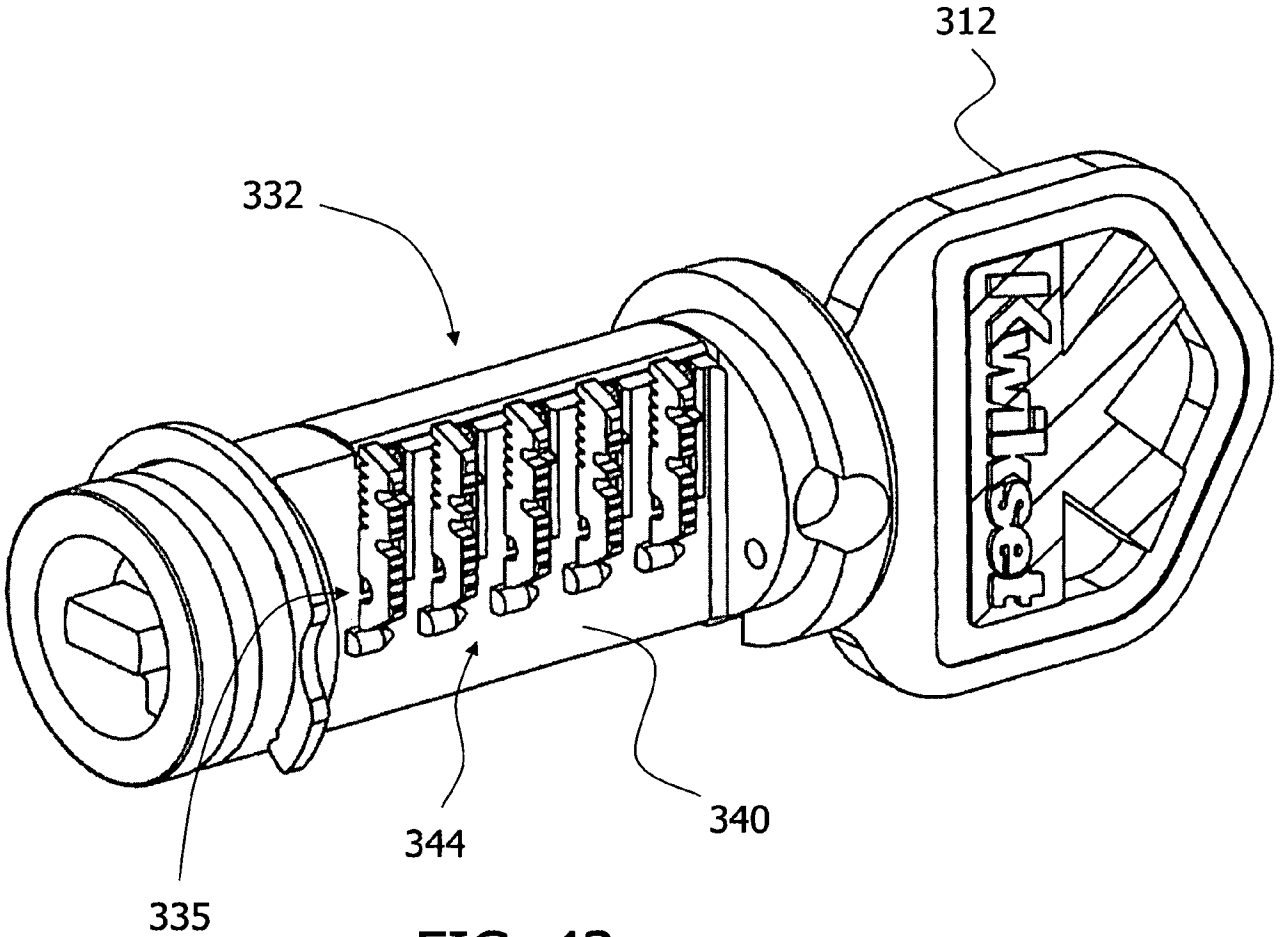
FIG. 43 shows the plurality of master racks positioned above the corresponding protrusion feature of the plug body.

At step S120, the carrier sub-assembly 346 is subsequently moved to the retracted position to decouple the plurality of master racks 332 from the plurality of pins 244 and position each rack 332A-332E above the corresponding protrusion feature 344 on the plug body 340, as shown in FIG. 43. The movement of carrier sub-assembly may be effected by rack carrier moving tool 162, by inserting tool 162 into the rekeying tool opening 358 in the plug face 360 of the plug assembly 316.

Figure 44:
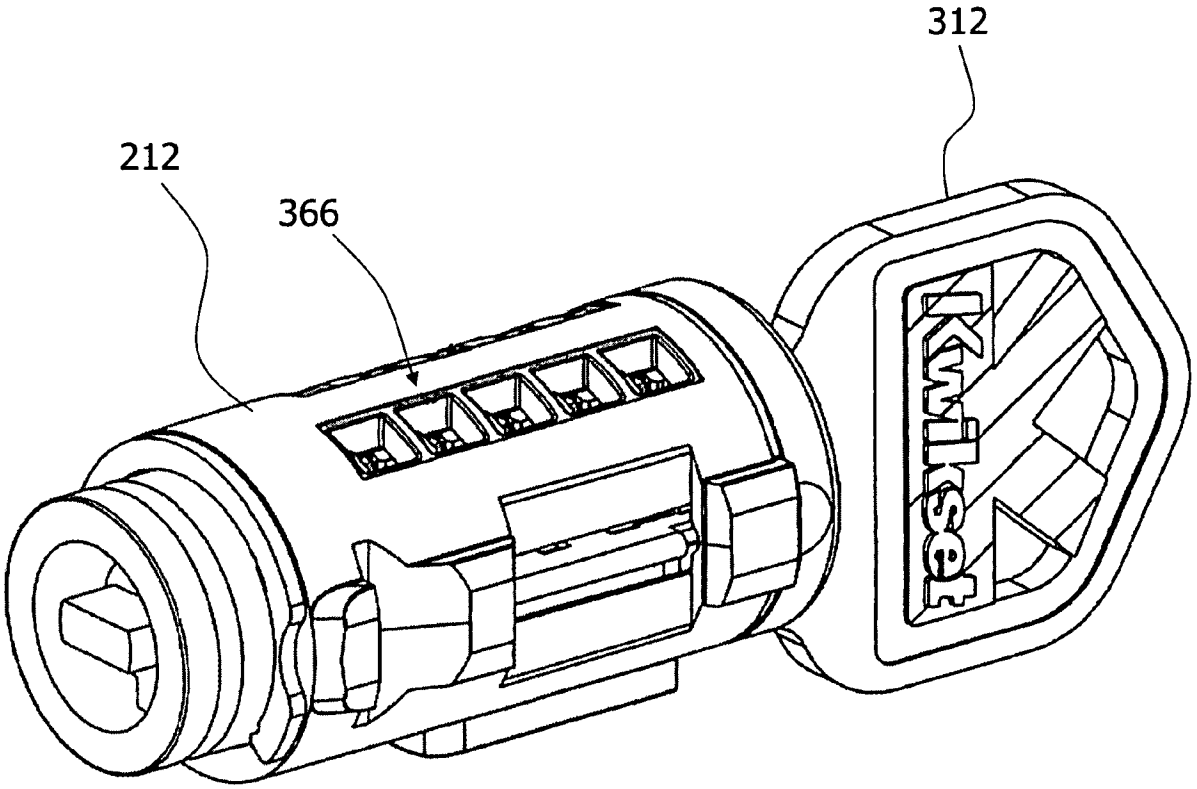
FIG. 44 shows the rack access holes in the cylinder body.
Figure 45:
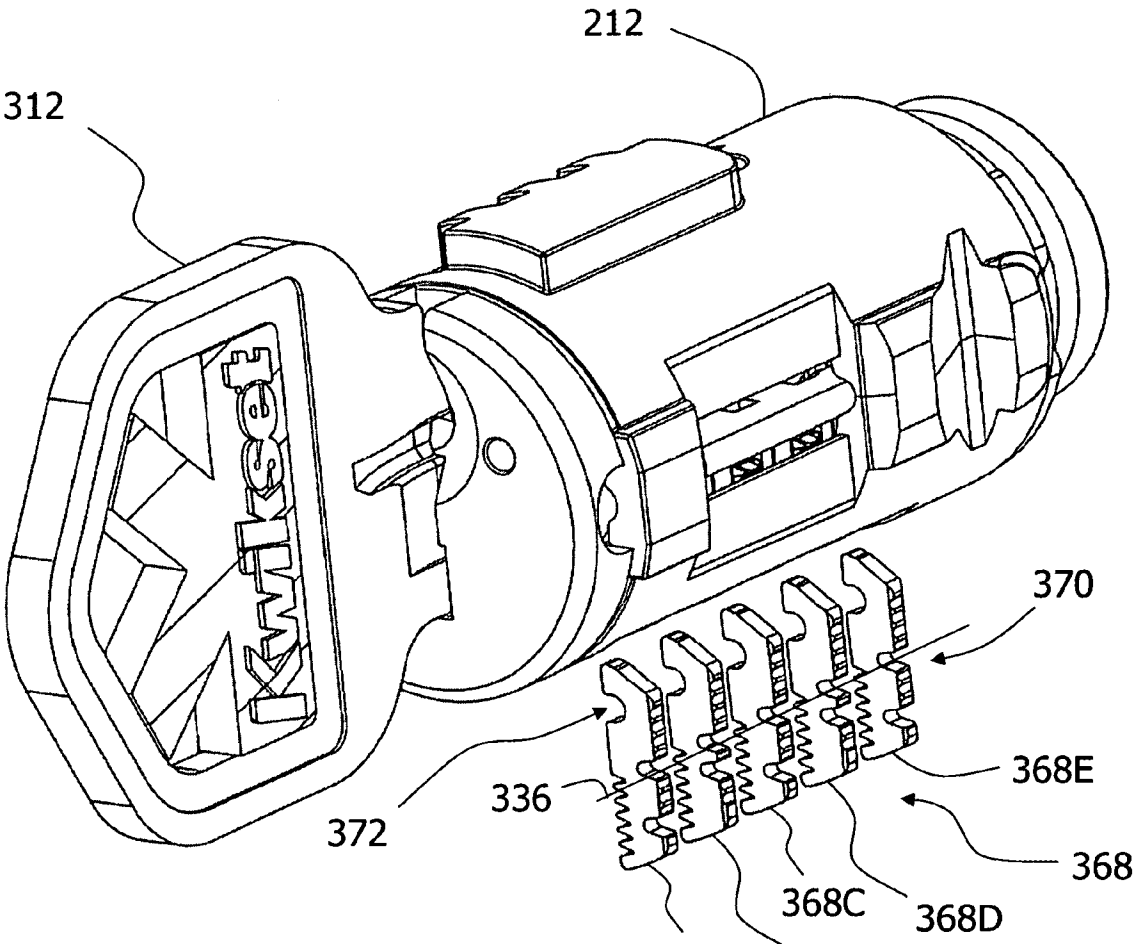
FIG. 45 shows a plurality of replacement master racks.

At step S122, one or more of the current plurality of master racks 332A-332E may now be removed from access holes 366 in the cylinder body 212 (see FIG. 44). In some cases, as in this example, each of the plurality of master racks 332 will be replaced by a corresponding plurality of replacement master racks 368 shown in FIG. 45, individually identified as 368A-368E.

At step S124, each of the plurality of replacement master racks 368 is inserted through a respective access hole 366 in cylinder body 212. The position of the plurality of replacement master racks 368 after the master racks 368 are inserted through the access holes 366 will be substantially like that of the plurality of master racks 332 shown in FIG. 43, wherein the plurality of replacement master racks 368 will be above, e.g., sitting on top of, the protrusion features 344 of the plug body 340.

Figure 46:
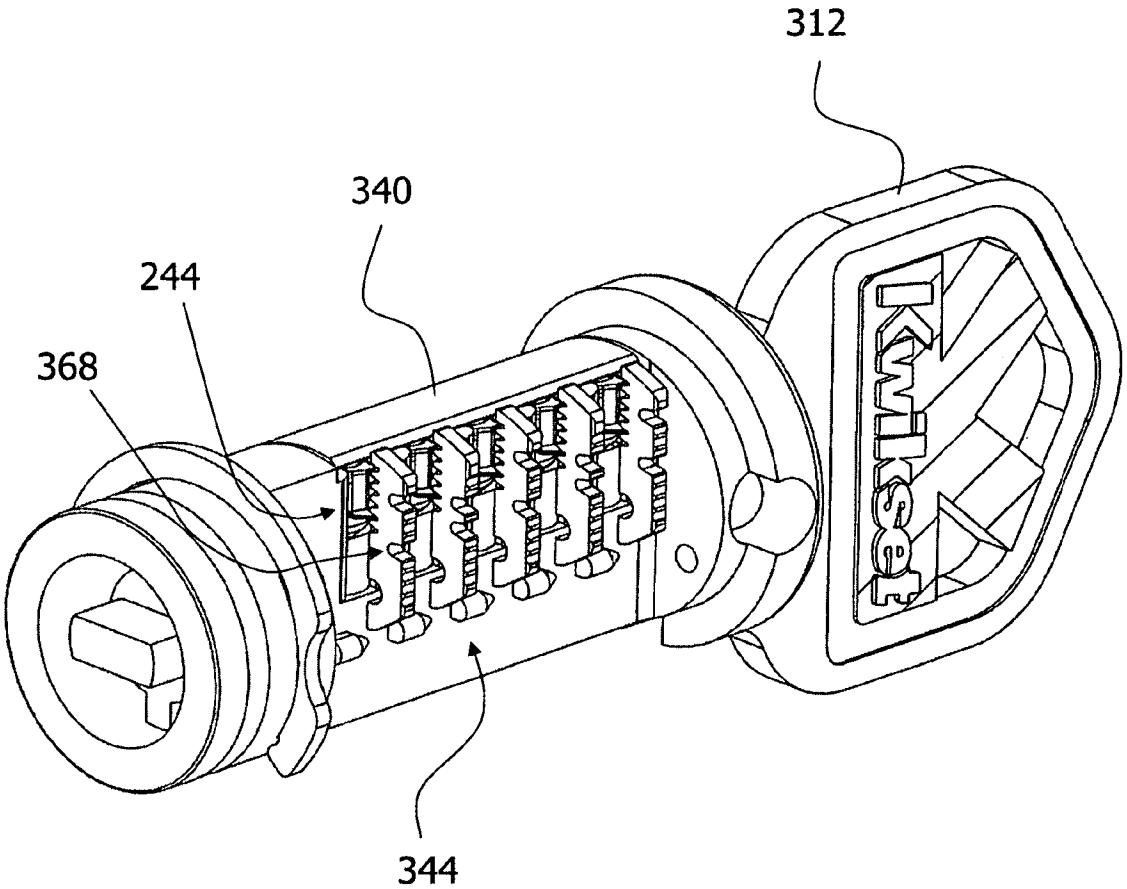
FIG. 46 shows the carrier sub-assembly released from the retracted position to engage the plurality of replacement master racks with the plurality of pins.

At step S126, the carrier sub-assembly 346 is released from the retracted position to engage the plurality of replacement master racks 368 with the plurality of pins 244, as shown in FIG. 46. Since no detent is provided in this example to hold the carrier sub-assembly 346 in the retracted position when the plug body 340 has been rotated by approximately 180 degrees, the carrier sub-assembly 346 is manually held in the retracted position, and manually released from the retracted position to move the plurality of replacement master racks 368 forward to clear the protrusion features 344 on plug body 340.

At step S128, the rack removal tool 312 is removed from the keyway 314.

Figure 47:
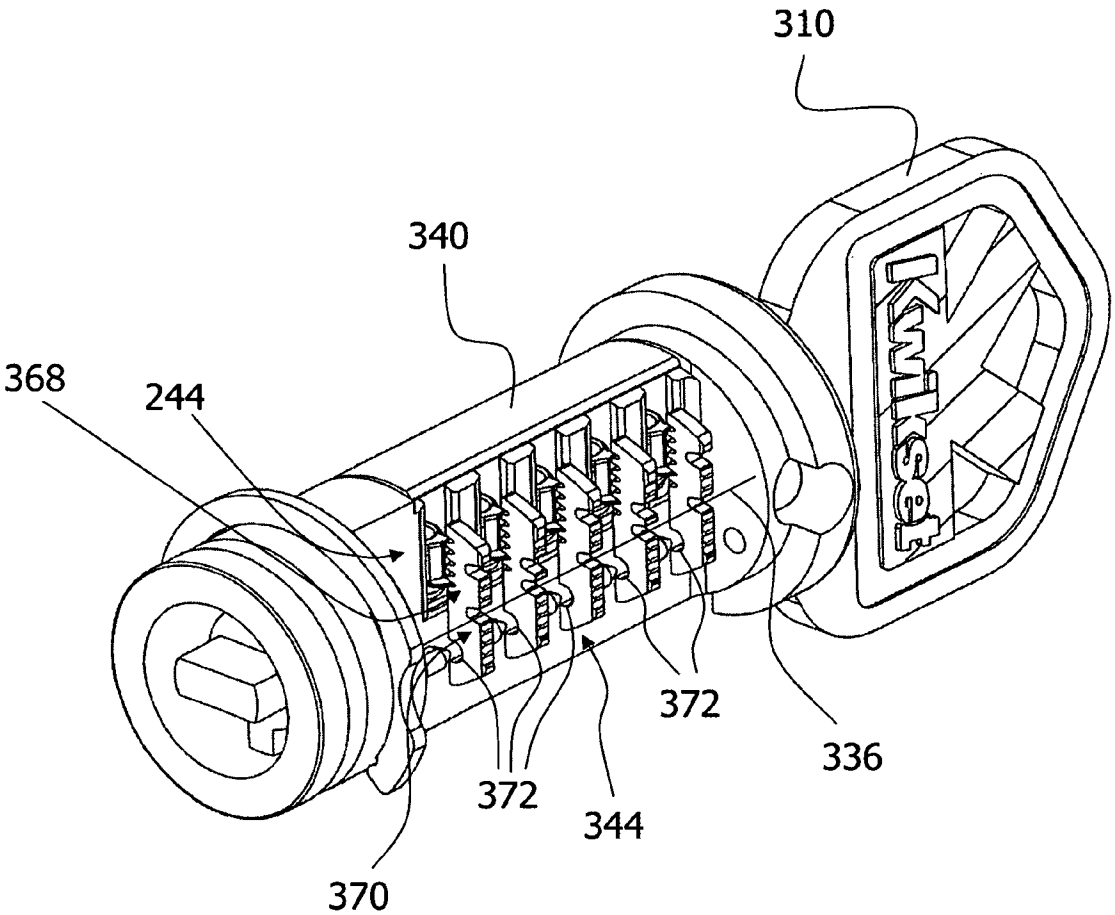
FIG. 47 shows the plurality of replacement master racks with the corresponding protrusion grooves lined up with the corresponding protrusion features on the plug body.
Figure 48:
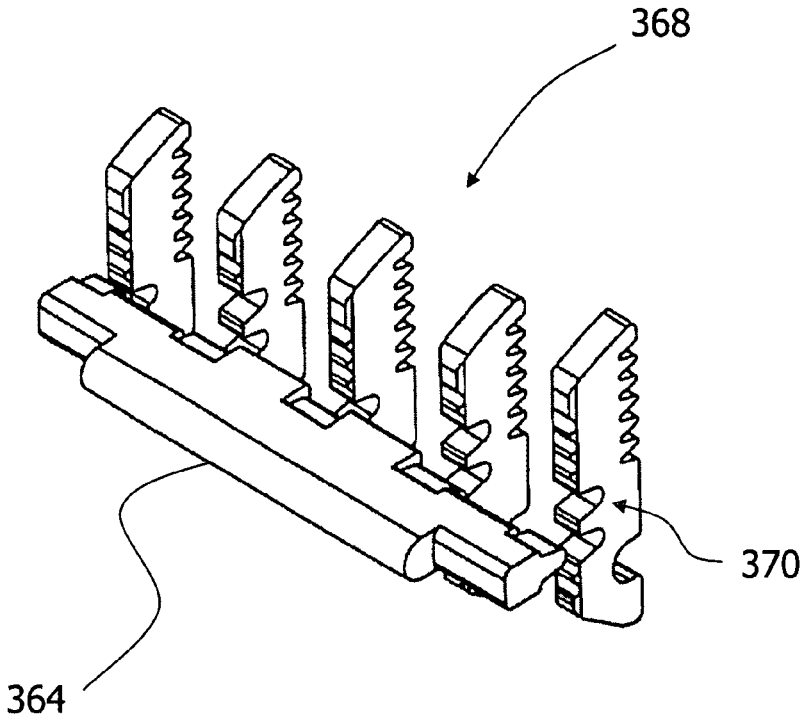
FIG. 48 shows the master locking bar-receiving grooves of the master racks positioned to receive the locking bar.

At step S130, the rack removal key 310 is reinserted in the keyway 314. This sets the position of the plurality of pins 244 and in turn lines up the master locking bar-receiving grooves 370 (see FIG. 45) along the neutral axis 336 of each of the plurality of replacement master racks 368, and in turn lines up the corresponding protrusion grooves 372 with the corresponding protrusion feature 344 on the plug body 340, as shown in FIG. 47. The master locking bar-receiving grooves of the master racks are now positioned to receive the locking bar 364, as shown in FIG. 48.

Figure 49:
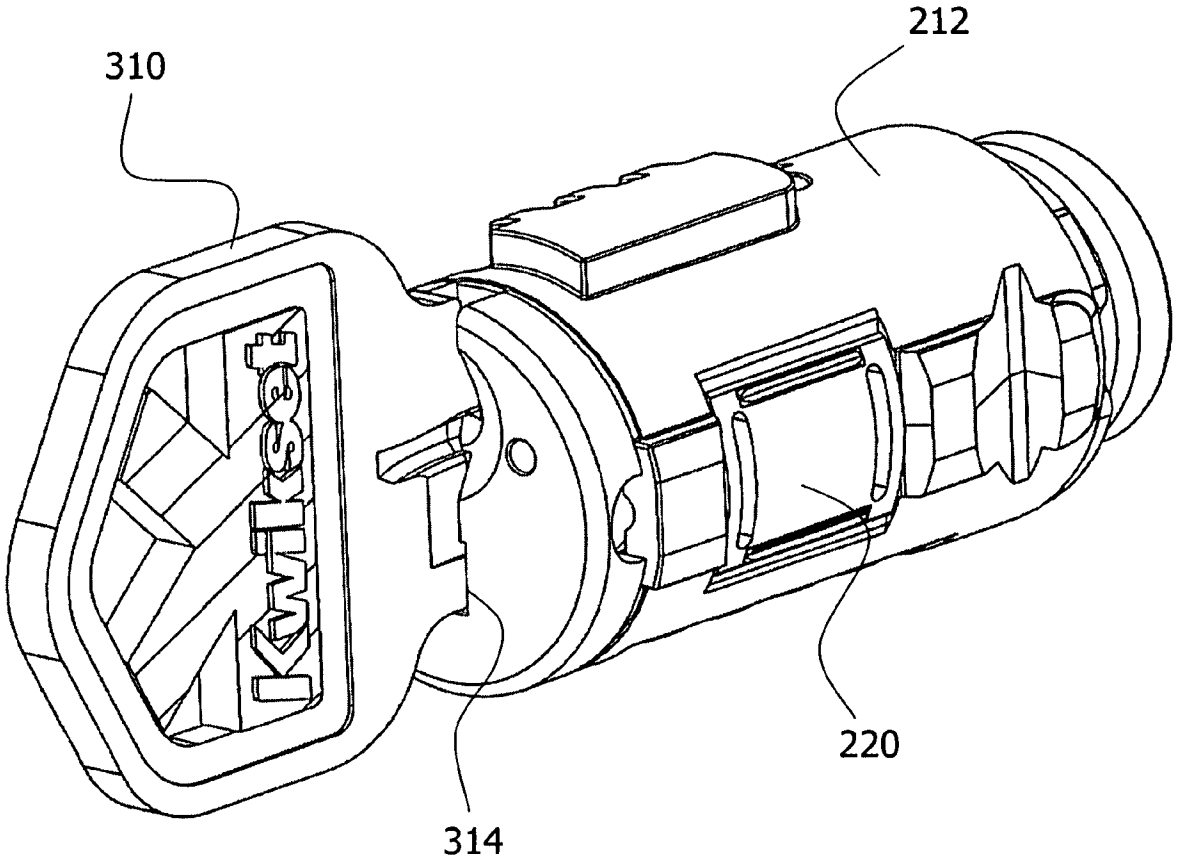
FIG. 49 shows the removable side panel reinstalled on the cylinder body.

At step S132, without removing the rack removal key 310, the removable side panel 220 is reinstalled as shown in FIG. 49 on to the cylinder body 212 so that the locking bar 364 engages with the master locking bar-receiving groove 370 of each replacement master rack 368A-368E of the plurality of replacement master racks 368, thereby coupling all of the plurality of replacement master racks 368 together.

Figure 50:
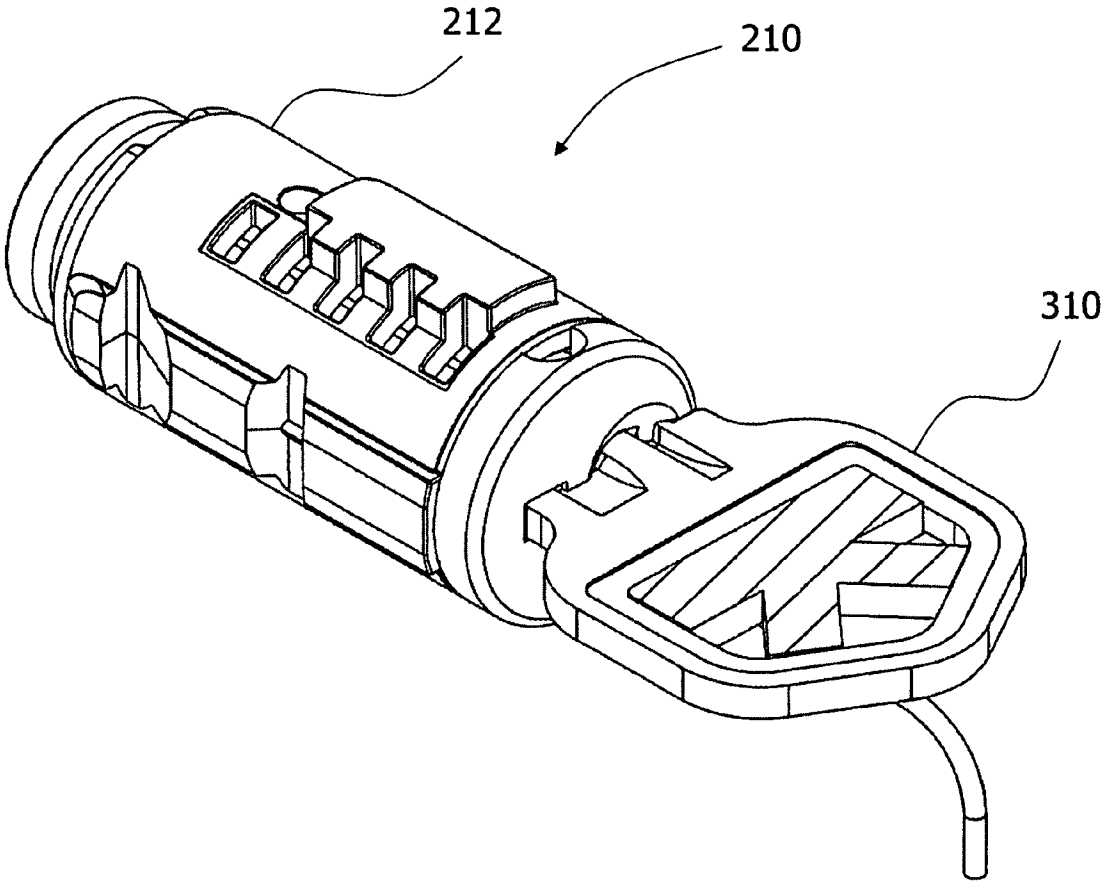
FIG. 50 shows the plug assembly in the learn mode position.

At step S134, the plug assembly 316 is rotated by approximately 90 degrees in a second rotational direction, e.g., clockwise, opposite to the first rotational direction, by a corresponding rotation of rack removal key 310. This places the plug assembly in the learn mode position, as shown in FIG. 50.

Figure 51:
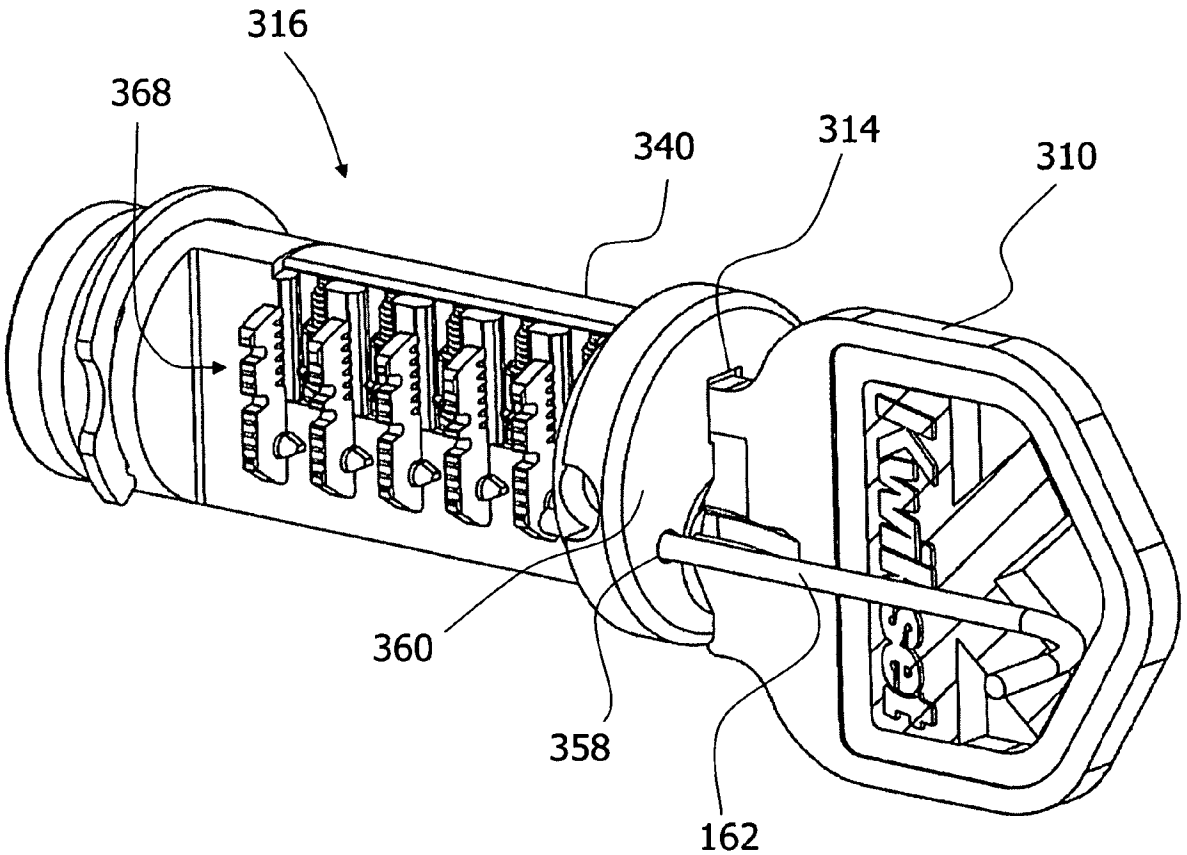
FIG. 51 shows the individual positions of each of the plurality of replacement master racks when the carrier sub-assembly is moved to the retracted position.

At step S136, the carrier sub-assembly 346 is subsequently moved to the retracted position to decouple the plurality of replacement master racks 368 from the plurality of pins 244 and position the protrusion grooves 372 of each replacement master rack 368A-368E over a corresponding protrusion feature 344 on the plug body 340. The movement of carrier sub-assembly may be effected by the rack carrier moving tool 162, by inserting the tool 162 into the rekeying tool opening 358 in the plug face 360 of the plug assembly 316. The individual positions of each of the plurality of replacement master racks 368 is shown in FIG. 51.

At step S138, the rack removal key 310 is removed from the keyway 314.

Figure 52:
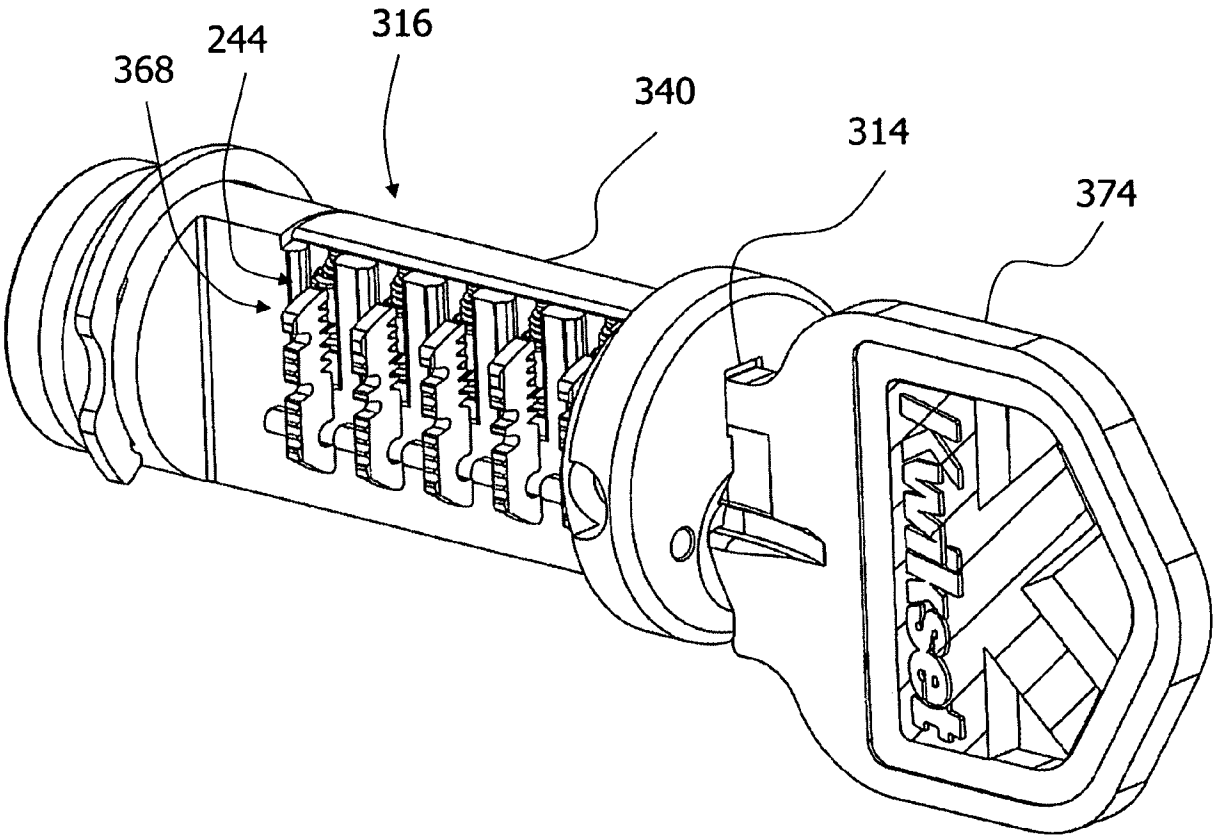
FIG. 52 shows the plug body rotated by a new master key in the second rotational direction back to the original position so as to reengage the plurality of replacement master racks with the plurality of pins.

At step S140, a new master key 374 is inserted into the keyway 314, as shown in FIG. 52.

At step S142, the plug body 340 is rotated in the second rotational direction back to the original position, as shown in FIG. 52, by a corresponding rotation of the new master key 374, to release the carrier sub-assembly 346 from the retracted position to reengage the plurality of replacement master racks 368 with the plurality of pins 244, to thereby learn the cut of the new master key 374, thereby completing the rekeying of lock cylinder 210 to the new master key 374.

The above-described embodiments, of course, are not to be construed as limiting the breadth of the present invention. Modifications and other alternative constructions will be apparent that are within the spirit and scope of the invention as defined in the appended claims.

The invention claimed is:

1. A kit for a master keying system, comprising:

a plurality of replacement master racks;

a rack removal key for insertion into a keyway, the rack removal key having a first cut defining a first lift amount;

a rack removal tool for insertion into the keyway, the rack removal tool having a second cut defining a second lift amount, the second lift amount being greater than the first lift amount and wherein a lock cylinder to be keyed has a rack carrier configured to selectively carry one of a first plurality of racks and the plurality of replacement master racks, the kit further comprising a rack carrier moving tool configured to move the rack carrier in a longitudinal direction.

2. A kit for a master keying system, comprising:

a plurality of replacement master racks;

a rack removal key for insertion into a keyway, the rack removal key having a first cut defining a first lift amount;

a rack removal tool for insertion into the keyway, the rack removal tool having a second cut defining a second lift amount, the second lift amount being greater than the first lift amount;

wherein a lock cylinder to be keyed has a rack carrier configured to selectively carry one of a first plurality of racks and the plurality of replacement master racks, the kit further comprising a rack carrier moving tool configured to move the rack carrier in a longitudinal direction; and wherein each rack of the plurality of replacement master racks has a first locking bar-receiving groove along a neutral axis and at least a second locking bar-receiving groove spaced from the neutral axis.

3. A kit for a master keying system, comprising:

a plurality of replacement master racks;

a rack removal key for insertion into a keyway, the rack removal key having a first cut defining a first lift amount;

a rack removal tool for insertion into the keyway, the rack removal tool having a second cut defining a second lift amount, the second lift amount being greater than the first lift amount;

a master key; and wherein a lock cylinder to be keyed has a rack carrier configured to selectively carry one of a first plurality of racks and the plurality of replacement master racks, the kit further comprising a rack carrier moving tool configured to move the rack carrier in a longitudinal direction.

4. The kit of claim 1, wherein each of the rack removal key and rack removal tool is configured to facilitate removal of a first plurality of racks, carried by a rack carrier of a lock cylinder to be keyed, for replacement by the plurality of replacement master racks.

5. The kit of claim 4, further comprising a master key.

6. The kit of claim 1, wherein the first lift amount of the first cut is constant along a length of the rack removal key, and the second lift amount of the second cut is constant along a length of the rack removal tool.

* * * * *